US007387059B2

(12) United States Patent
Kobayashi

(10) Patent No.: US 7,387,059 B2
(45) Date of Patent: Jun. 17, 2008

(54) SHEET PUNCHING APPARATUS, SHEET FINISHING APPARATUS, AND IMAGE FORMING APPARATUS

(75) Inventor: Misao Kobayashi, Kofu (JP)

(73) Assignee: Nisca Corporation, Minamikoma-Gun, Yamanashi (JP)

( * ) Notice: Subject to any disclaimer, the term of this patent is extended or adjusted under 35 U.S.C. 154(b) by 413 days.

(21) Appl. No.: 10/995,899

(22) Filed: Nov. 24, 2004

(65) Prior Publication Data

US 2005/0115377 A1 Jun. 2, 2005

(30) Foreign Application Priority Data

Nov. 28, 2003 (JP) ..... 2003-398961
Nov. 28, 2003 (JP) ..... 2003-399039

(51) Int. Cl.
*B26D 5/00* (2006.01)
*B02C 18/22* (2006.01)

(52) U.S. Cl. ..... 83/684; 83/167; 83/681; 83/687; 241/100; 241/172; 493/82; 493/373

(58) Field of Classification Search ..... 83/658, 83/684, 687, 549, 681, 831, 667, 669, 682, 83/683, 691, 167; 493/373, 82, 83, 343; 241/100, 172, 181, 183
See application file for complete search history.

(56) References Cited

U.S. PATENT DOCUMENTS

| | | | | |
|---|---|---|---|---|
| 3,386,654 | A | 6/1968 | Wallace | 234/34 |
| 3,677,117 | A | 7/1972 | Cutter | 83/150 |
| 4,809,576 | A | 3/1989 | Bakermans et al. | 83/155 |
| 5,988,541 | A | 11/1999 | Barone | 241/100 |
| 6,135,374 | A | 10/2000 | Hansen et al. | 241/46.013 |
| 2004/0237748 | A1 | 12/2004 | Potthoff et al. | 83/684 |
| 2005/0061131 | A1 | 3/2005 | Tamura et al. | 83/681 |

FOREIGN PATENT DOCUMENTS

JP 11-139671 5/1999

*Primary Examiner*—Ghassem Alie
(74) *Attorney, Agent, or Firm*—Manabu Kanesaka

(57) ABSTRACT

A sheet punching apparatus includes a transport unit for receiving a sheet; a hole punching device for punching a hole in the sheet transported to the transport unit; a punch scrap container for storing punch scraps after the hole punching device punches the hole; a sweeping device for sweeping a top portion of the punch scraps stored in the punch scrap container to level the top portion; and a drive device for driving the hole punching device and the sweeping device. A sheet finishing apparatus and an image forming apparatus includes the sheet punching apparatus.

10 Claims, 11 Drawing Sheets

SHEET PUNCHING APPARATUS, SHEET FINISHING APPARATUS, AND IMAGE FORMING APPARATUS

BACKGROUND OF THE INVENTION AND RELATED ART STATEMENT

The present invention relates to a sheet punching apparatus, a sheet finishing apparatus, and an image forming apparatus. More specifically, the present invention relates to a sheet punching apparatus for punching a hole in a sheet, a sheet finishing apparatus provided with the sheet punching apparatus, and an image forming apparatus provided with the sheet punching apparatus or the sheet finishing apparatus.

Generally, an image forming apparatus such as a copier, printer, and facsimile forms an image on a sheet, and the sheet is finished such as being punched with a hole (specifically holes for filing) and being bound in a file binder. In recent years, in order to streamline the finishing process, a sheet punching apparatus for punching a hole in a sheet with an image has become commercially available as a part of an image forming apparatus, a peripheral device, or a device as a stand-alone type independent of an image forming apparatus. Such a sheet punching apparatus is provided with a punch scrap container for storing punch scraps of holes after the holes are punched in sheets.

The punch scraps tend to accumulate at a specific location inside a punch scrap container corresponding to a position of a sheet punching position. Accordingly, in order to prevent the punch scraps from overflowing the container, in an image forming apparatus, a drive source for transporting a sheet may be used as a drive source for vibrating the punch scrap container to level the punch scraps therein. The image forming apparatus may also be provided with an optical sensor for detecting an amount of the punch scraps inside the punch scrap container after the punch scraps are leveled, thereby indicating that the punch scrap container is filled with the punch scraps (refer to Japanese Patent Publication (Kokai) No. 11-139674).

In the apparatus disclosed in Japanese Patent Publication (Kokai) No. 11-139674, it takes a large amount of energy to vibrate the punch scrap container. It is also necessary to provide a drive mechanism for vibrating the container, thereby increasing a size of a sheet punching apparatus. In particular, a sheet transport device and the punch scrap container are arranged away from a drive source, and it is necessary to transmit a driving force to the sheet transport device and the punch scrap container from the common drive source, thereby increasing a size of a transmission mechanism (drive transmission system) and a size of the sheet punching apparatus.

Further, when a sheet is transported and the punch scrap container is vibrated at the same time, it is necessary to increase a load on the drive source, thereby increasing energy consumption and vibration, or making it difficult to transport a sheet properly. If a sheet is transported and the punch scrap container is vibrated at a different timing, it is difficult to improve efficiency of the sheet punching apparatus.

In the apparatus disclosed in Japanese Patent Publication (Kokai) No. 11-139674, even when the paper scraps are leveled with vibration, the scraps may move fluidly inside the punch scrap container, thereby creating an uneven level of the punch scraps. When the optical sensor detects the uneven level of the punch scraps, the optical sensor may erroneously detects that the punch scrap container is full due to the movement of the punch scraps. Also, it detected that the punch scrap container is full after the punch scraps are leveled with vibration. Accordingly, it takes a long time to level the punch scraps, thereby lowering efficiency of the detection.

In view of the problems described above, an object of the present invention is to provide a sheet punching apparatus with a compact structure for efficiently punching a hole in a sheet, a sheet finishing apparatus provided with the sheet punching apparatus, and an image forming apparatus provided with the sheet punching apparatus or the sheet finishing apparatus.

Another object of the present invention is to provide a sheet punching apparatus in which it is possible to detect accurately and efficiently that a punch scrap container becomes full, a sheet finishing apparatus and an image forming apparatus provided with the sheet punching apparatus.

Further objects and advantages of the invention will be apparent from the following description of the invention.

SUMMARY OF THE INVENTION

To attain the objects described above, according to a first aspect of the present invention, a sheet punching apparatus includes a transport unit for receiving a sheet; a punching device for punching a hole in the sheet transported to the transport unit; a punch scrap container for storing punch scraps after the punching device punches the hole; a sweeping device for sweeping a top portion of the punch scraps stored in the punch scrap container to level the top portion; and a drive device for driving the punching device and the sweeping device.

In the first aspect of the present invention, the drive device is provided for driving both of the punching device and the sweeping device. The transport unit transports the sheet into the sheet punching apparatus, and the punching device performs a hole punching process on the sheet. After the hole punching process, the punch scraps are stored in the punch scrap container. The sweeping device sweeps the top portion of the punch scraps stored in the punch scrap container, thereby leveling the top portion of the punch scraps. The punch scrap container is arranged close to the punching device for storing the punch scraps after the hole punching process, and the sweeping device is arranged close to the punch scrap container for sweeping the top of the punch scraps stored in the punch scrap container. Accordingly, the punching device and the sweeping device are arranged close to each other with the punch scrap container in between.

In the first aspect of the present invention, the punching device and the sweeping device are arranged close to each other, thereby reducing a size of a drive transmission system. The drive device drives the punching device and the sweeping device, thereby reducing a size of the sheet punching apparatus. The sweeping device does not need to sweep only the top portion of the punch scraps, not all of the punch scraps stored in the punch scrap container, thereby leveling the punch scraps with low energy consumption and reducing a load on the drive device. Accordingly, even if the common drive device drives the punching device and the sweeping device, it is possible to efficiently punch the hole in the sheet and level the punch scraps without problems.

In the first aspect of the present invention, a control device may be provided for controlling an operational timing of the punching device and the sweeping device. When the control device controls the drive device so that the punching device and the sweeping device operate at the same time, it is possible to perform the punching process and the leveling process in an overlapped timing. Accordingly, it is possible to maintain the top portion of the punch scraps stored in the punch scrap container at a level. When the control device controls the drive device so that the sweeping device operates after the hole punching process by the punching device, the punching process and the leveling process are performed at different timings, thereby reducing a load on the drive device. In this case, the drive device is formed of a motor capable of rotating in both forward and reverse directions. A clutch may be provided for transmitting drive power of the drive device to the sweeping device only when the motor rotates in one of the forward and reverse directions.

According to a second aspect of the present invention, a sheet finishing apparatus includes a transport unit for receiving a sheet; a punching device for punching a hole in the sheet transported to the transport unit; a punch scrap container for storing punch scraps after the punching device punches the hole; a sweeping device for sweeping a top portion of the punch scraps stored in the punch scrap container to level the top portion of the punch scraps; a discharge device for discharging the sheet after the hole punching process; a sheet storage device for storing the sheet after the discharge device discharges the sheet; and a drive device for driving the punching device and the sweeping device. In the second aspect, in addition to advantages of the first aspect, the discharge device discharges the sheet after the hole punching process to be stored in the sheet storage device.

According to a third aspect of the present invention, an image forming apparatus includes an image forming device for forming an image on a sheet; a transport device for transporting the sheet with the image formed by the image forming device; a punching device for punching a hole in the sheet transported by the transport device; a punch scrap container for storing punch scraps after the punching device punches the hole; a sweeping device for sweeping a top portion of the punch scraps stored in the punch scrap container to level the top portion; and a drive device for driving the punching device and the sweeping device.

According to a fourth aspect of the present invention, a sheet punching apparatus includes a transport unit for receiving a sheet; a punching device for punching a hole in the sheet transported to the transport unit; a punch scrap container for storing punch scraps after the punching device punches the hole; a sweeping device for sweeping a top portion of the punch scraps stored in the punch scrap container to level the top portion; a drive device for driving the sweeping device; and a detection device for detecting a position of the sweeping device to detect that the punch scrap container is full.

In the fourth aspect of the present invention, the transport unit transports the sheet to the sheet punching apparatus, and the punching device performs a hole punching process in the sheet. After the hole punching process, the punch scraps are stored in the punch scrap container. After the sweeping device sweeps the punch scraps, when the punch scrap container has a room for storing the punch scraps (not full), the sweeping device moves between positions where the sweeping device contacts the punch scrap container to restrict a movement thereof. Accordingly, the top portion of the punch scraps in the punch scrap container is swept and leveled.

When the punch scrap container becomes full, the punch scraps between the punch scrap container and the sweeping device limit and prevent the sweeping device from moving to the positions where the sweeping device contacts the punch scrap container. Accordingly, the detection device detects the position of the sweeping device to detect that the punch scrap container is full.

In the fourth aspect of the present invention, the detection device detects the sweeping device at a position where the sweeping device does not contact the punch scrap container due to the punch scraps, thereby detecting that the punch scrap container is full. Accordingly, regardless of a shape of the punch scraps stored in the punch scrap container, it is possible to accurately detect that the container means is full. Further, the sweeping device sweeps the punch scraps and the detection device detects the full status of the container at the same time, thereby making it possible to efficiently detect that the punch scrap container is full.

According to a fifth aspect of the present invention, a sheet punching apparatus includes a transport unit for receiving a sheet; a punching device for punching a hole in the sheet transported to the transport unit; a punch scrap-container for storing punch scraps after the punching device punches the hole; a sweeping device for sweeping a top portion of the punch scraps stored in the punch scrap container to level the top portion; a drive device for driving the sweeping device; and a detection device for detecting a load applied on the drive device to detect that the punch scrap container is full.

In the fifth aspect of the present invention, the sheet is transported to the sheet punching apparatus by the transport unit, and a hole punching process is performed in the sheet by the punching device. After the punching process, the punch scraps are stored in the punch scrap container. After the sweeping device sweeps the punch scraps, when the punch scrap container has a room for storing the punch scraps, the sweeping device moves between positions where the sweeping device contacts the punch scrap container to restrict a movement thereof. Accordingly, the top portion of the punch scraps in the punch scrap container is swept and leveled.

When the punch scrap container becomes full, the punch scraps between the punch scrap container and the sweeping device limit and prevent the sweeping device from moving to the positions where the sweeping device contacts the punch scrap container. At this time, a large load is applied on the drive device. Accordingly, the detection device detects the load applied on the drive device to detect that the punch scrap container is full, thereby obtaining the same effect as the first aspect.

In the fourth and fifth aspects of the present invention, it may be arranged such that the drive device drives the punching device. In this case, the sweeping device may have a rotating shaft arranged above the punch scrap container and a sweeping member supported on the rotating shaft for sweeping the punch scraps. Alternatively, the sweeping device may have a sliding member arranged above the punch scrap container and a sweeping member supported on the sliding member for sweeping the punch scraps.

According to a sixth aspect of the present invention, a sheet finishing apparatus includes a transport unit for receiving a sheet; a punching device for punching a hole in the sheet transported to the transport unit; a punch scrap container for storing punch scraps after the punching device punches the hole; a sweeping device for sweeping a top portion of the punch scraps stored in the punch scrap container to level the top portion; a drive device for driving the sweeping device; a discharge device for discharging the sheet after a hole punching process by the punching device; a sheet storage device for storing the sheet discharged by the discharge device; and a detection device for detecting a position of the sweeping device to detect that the punch scrap container is full.

In the sixth aspect of the present invention, the sheet finishing apparatus is provided with the sheet punching apparatus of the fourth aspect. Accordingly, in addition to the effect of the fourth aspect, the discharge device discharges the sheet to be stored in the sheet storage device.

According to a seventh aspect of the present invention, a sheet finishing apparatus includes a transport unit for receiving a sheet; a punching device for punching a hole in the sheet transported to the transport unit; a punch scrap container for storing punch scraps after the punching device punches the hole; a sweeping device for sweeping a top portion of the punch scraps stored in the punch scrap container to level the top portion; a drive device for driving the sweeping device; a discharge device for discharging the sheet after a hole punching process of the punching device; a sheet storage device for storing the sheet discharged by the discharge device; and a detection device for detecting a load on the drive device to detect that the punch scrap container is full.

In the seventh aspect of the present invention, the sheet finishing apparatus is provided with the sheet punching apparatus of the fifth aspect. Accordingly, in addition to the effects of the fifth aspect, the sheet is discharged by discharge device to be stored in the sheet storage device.

According to an eighth aspect of the present invention, an image forming apparatus includes an image forming device for forming an image on a sheet; a transport device for transporting the sheet with the image formed by the image forming device; a transport unit for receiving the sheet transported by the transport device; a punching device for punching a hole in the sheet transported to the transport unit; a punch scrap container for storing punch scraps after the punching device punches the hole; a sweeping device for sweeping a top portion of the punch scraps stored in the punch scrap container to level the top portion; a drive device for driving the sweeping device; and a detection device for detecting a position of the sweeping device to detect that the punch scrap container is full.

The image forming apparatus of the eighth aspect is provided with the sheet punching apparatus of the first aspect, and may be provided with the sheet finishing apparatus of the sixth aspect.

According to a ninth aspect of the present invention, an image forming apparatus includes an image forming device for forming an image on a sheet; a transport device for transporting the sheet with the image formed by the image forming device; a transport unit for receiving the sheet transported by the transport device; a punching device for punching a hole in the sheet transported to the transport unit; a punch scrap container for storing punch scraps after a hole punching process of the punching device; a sweeping device for sweeping a top portion of the punch scraps stored in the punch scrap container to level the top portion; a drive device for driving the sweeping device; and a detection device for detecting a load on the drive device to detect that the punch scrap container is full.

The image forming apparatus of the ninth aspect is provided with the sheet punching apparatus of the fifth aspect, and may be provided with the sheet finishing apparatus of the sixth aspect.

According to the present invention, the punching device and the sweeping device are arranged close to each other, thereby reducing a size of the drive transmission system. The drive device is shared, thereby reducing a size of the sheet punching apparatus. The sweeping device sweeps only the top portion of the punch scraps stored in the punch scrap container, not all of the punch scraps, to level the top portion, thereby reducing energy consumption and a load applied to the drive device. Accordingly, the hole punching process can be performed when the drive device drives the punching device and the sweeping device, thereby efficiently leveling the punch scraps.

According to the present invention, the detection device detects the position where the punch scraps prevent the sweeping device from contacting the punch scrap container, or the load applied to the drive device to detect that the punch scrap container is full. Accordingly, regardless of a shape of the punch scraps in the punch scrap container, it is possible to accurately detect that the container means is full. It is also possible that the detection device detects and the sweeping device sweeps at the same time, thereby efficiently detecting that the punch scrap container is full.

DETAILED DESCRIPTION OF PREFERRED EMBODIMENTS

Hereunder, embodiments of the present invention will be explained with reference to the accompanying drawings.

Figure 1:
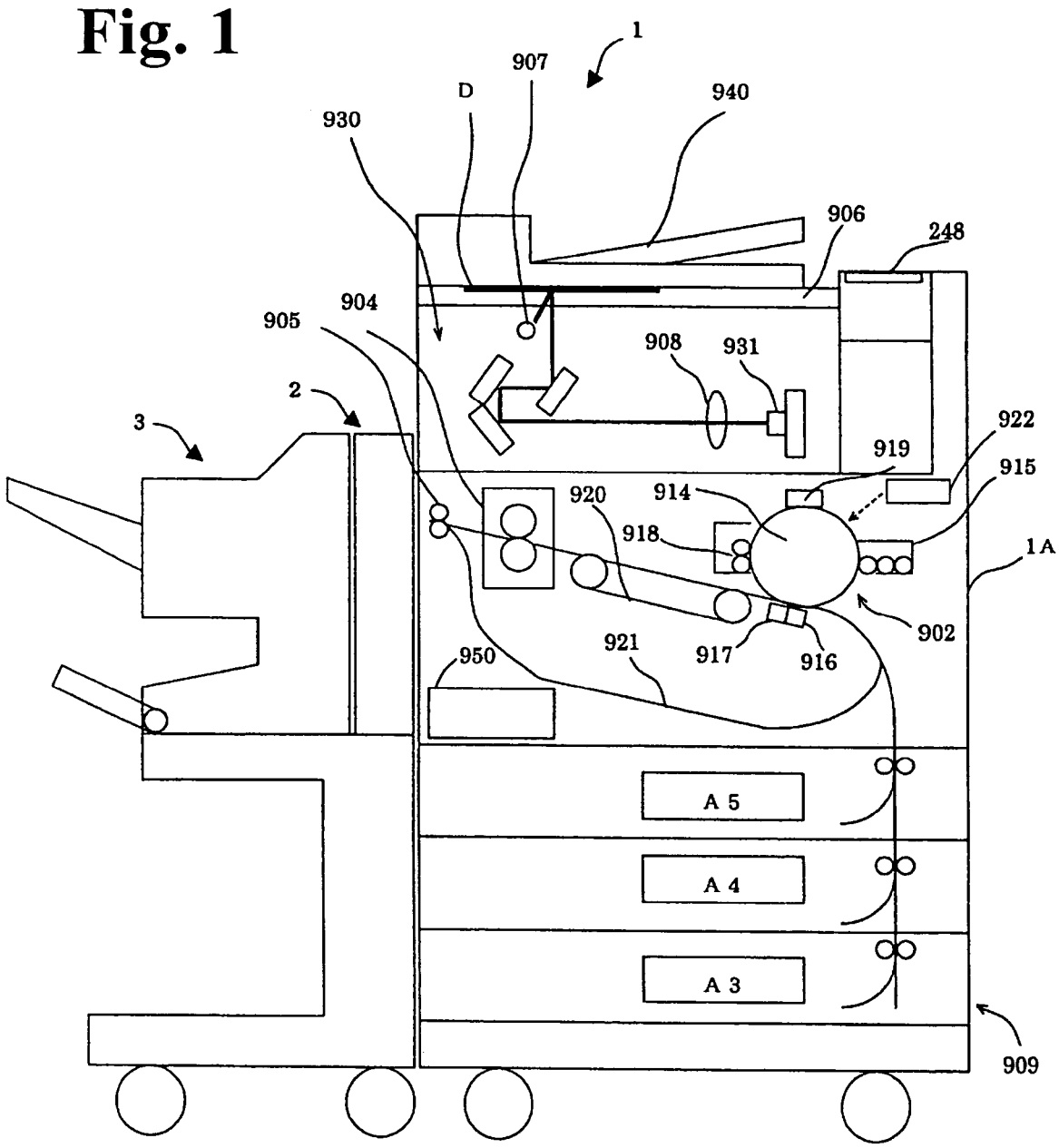
FIG. 1 is a partially sectional front view of a copier according to a first embodiment of the present invention.

Referring to FIG. 1, a copier 1 comprises a digital copier 1A for forming images on sheets; a sheet punching apparatus 2 mounted to the copier 1A for punching holes in sheets transported by the copier 1A; and a sheet finishing apparatus 3 mounted at a downstream side of the sheet punching apparatus 2 for binding or folding a stack of a plurality sheets.

The copier 1A includes an image forming unit 902 for forming an image of an original D on a sheet; a light source 907 disposed above the image forming unit 902 for irradiating light onto the original D and focusing light reflected from the original D to form an image thereof on a CCD 931 via an optical system 908; an image input unit 930 as a so-called scanner; and a controller 950 for controlling the units.

The image forming portion 902 comprises a cylindrical photoconductive drum 914 with an outer surface capable of forming latent images. Around the photoconductive drum 914, there are provided a primary electrostatic charger 919 for electrostatically charging the photoconductive drum 914 to form a latent image; a laser unit 922 for outputting a modulated laser beam on the photoconductive drum 914 according to image data stored in a hard disk; a developer 915 for developing the electrostatic latent image formed on the photoconductive drum 914 as a toner image; an electrostatic charger 916 for applying an electrostatic charge to transfer the toner image onto a sheet; a separating charging unit 917 for charging the sheet with polarity opposite to the electrostatic charger 916 to separate the sheet from the photoconductive drum 914; and a cleaner 918 for cleaning the photoconductive drum 914.

The laser unit 922 comprises a semiconductor laser for emitting a laser beam; a polygon mirror for converting the laser beam from the semiconductor laser into a beam for each one line via a collimator lens; an fθ lens for converting the laser beam from the polygon mirrors for each line into parallel light; a mirror for reflecting the parallel light from the fθ lens to the photoconductive drum 914; and a motor for rotating the polygon mirror.

A roller with an endless transport belt 920 is arranged at a downstream side of the photoconductive drum 914 near the separating charging unit 917. The endless transport belt 920 is entrained to another roller arranged near a fixing unit 904 with a heater roller for heating and fixing the toner image onto the sheet. A pair of discharge rollers 905 is arranged at a downstream side of the fixing unit 904 for discharging the sheet with the image from the copier 1A. A duplex 921 is arranged below the endless transport belt 920 and between the discharge rollers 905 and photoconductive drum 914 for forming an image on the other side of the sheet with the image on one side for duplex printing.

A platen 906 is arranged on a top portion of the copier unit 1A for placing an original D. An automatic document feeder (ADF) 940 is arranged to cover the platen glass 906. One side of the ADF 940 is fastened above the platen 906, and the other side is rotatable to cover the platen 906. The ADF 940 automatically feeds the original D to the platen glass 906. Also, below the copier 1A is mounted a paper feeder 909 for sending a predetermined size of sheet one at a time to the copier 1A. The paper feeder 909 comprises detachable cassettes that store A5, A4, and A3 size sheets. The paper feeder 909 is controlled by a control unit (not shown) that controls the drive rotation of the pair of rollers for feeding the sheets toward the image forming unit 902. Note that settings such as the selection of sheet size can be performed using the touch panel 248.

The control unit 950 is composed of a CPU (CPU1A) that operates as a central processing unit; a ROM that stores a basic control program digital copier 1A; and an internal bus that acts as a CPU1A work area and connects the RAM to the units. An external bus is connected to the control unit 950. The external bus is connected to an image input unit 930, an A/D converter converts analog image data input by the image input unit 930 into a digital image data; an image forming unit 902; a touch panel control unit for controlling a display on the touch panel 248 and an operating instruction; and a hard disk that stores the image data sent from the image input unit 930 or an external apparatus such as a personal computer. Also, the external bus is connected to an actuator control unit that drives and activates a stepping motor and solenoids (not shown). The external bus is also connected to a control unit of the paper feeder 909 and ADF 940; a control unit 290 of a sheet punching apparatus 2 (described later); and a control unit 149 of a sheet finishing apparatus 3 via an interface (not shown) to communicate with the peripheral devices.

Figure 2:
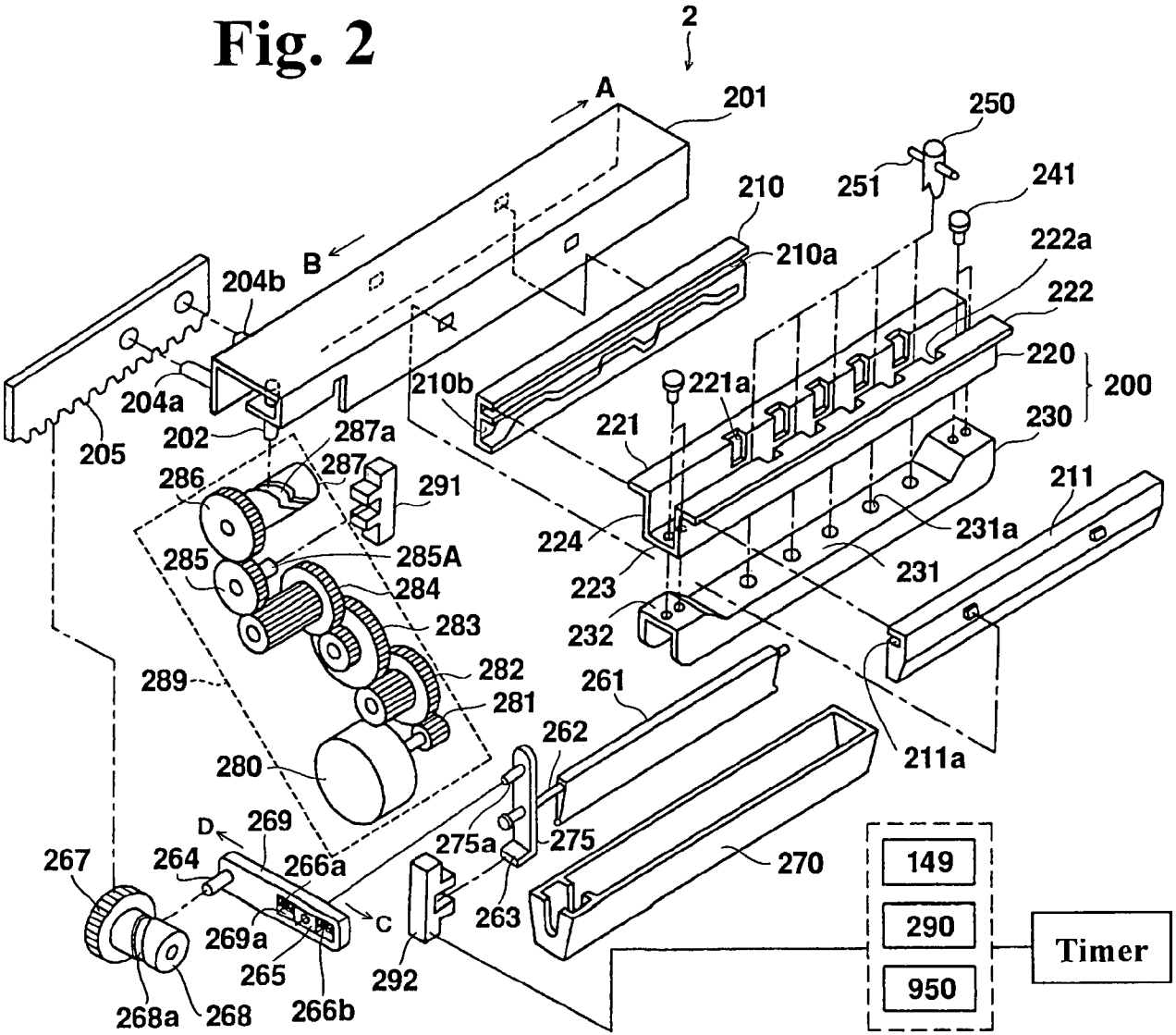
FIG. 2 is an exploded perspective view of a sheet punching apparatus according to the first embodiment of the present invention.

As shown in FIG. 2, the sheet punching apparatus 2 comprises five cylindrically shaped punches 250 that punch holes in the sheets. The punches 250 are provided with punch blades on a lower side thereof, and activating pins 251 penetrating the punches 250 in a direction orthogonal to a shaft direction. The punches 250 are stored in a punch guide 200 mounted onto a sheet transport path 245 (see FIG. 3) as a part of a transport unit. The punch guide 200 is composed of an upper punch guide 220 and a lower punch guide 230.

The upper punch guide 220 is composed of a channel shaped member. A rising portion 224 of the channel shaped member comprises flanges 221 and 222 with a substantially L-shape section bending toward outside on both sides. Five rectangular-cut pin penetration windows 221*a* are formed and communicate with one side of the rising portion 224 and the flange portion 221. Similar to the pin penetration windows 221*a*, pin penetration windows 222*a* are formed in positions directly opposite to the pin penetration windows 221*a* on the other side of the rising portion 224 and the flange portion 222. Furthermore, five cylindrical penetration holes (not shown) are formed at the center of the channel bottom portion 223 of the upper punch guide 220 corresponding to the positions of the pin penetration windows 221*a* and 222*a* formed in the rising portion 224, so that the punching blades of the punches 250 advance downwardly.

The lower punch guide 230 is also composed of a channel shaped member having a central flat portion 231 and protruding flat portions 232 on both sides. Five cylindrical penetration holes are formed in the central flat portion 231 corresponding to the positions of the pin penetration holes formed in the channel bottom portion 223 of the upper punch guide 220, so that the punching blades of the punches 250 advance.

The channel bottom portion 223 of the upper punch guide 220 is fastened to the protruding flat portions 232 of the lower punch guide 230 at both sides by screws 241. A space (transport space) is formed between the channel bottom portion 223 of the upper punch guide 220 and the central flat portion 231 of the lower punch guide 230 as a part of the transport unit for transporting the sheets in and out.

The activating pins 251 of the punches 250 penetrate the pin penetration windows 221*a* and 222*a*, and engage guide grooves 210*b* and 211*b* (see FIG. 4) formed in the sliders 210 and 211. The guide grooves 210*b* and 211*b* are formed in surfaces of the sliders 210 and 211 facing the upper punch guide 220 along a longitudinal direction. The guide grooves 210*b* and 211*b* are formed of an upper side groove, a lower side groove, and an oblique groove connected between upper and lower grooves. Slider grooves 210*a* and 211*a* are formed in the sliders 210 and 211 above the guide grooves 210*b* and 211*b*, and extend in a substantially horizontal direction along the longitudinal direction. The flange portions 221 and 222 on the upper punch guide 220 have leading edges contacting the slider grooves 210*a* and 211*a*.

The sliders 210 and 211 comprise two protrusions on sides facing the surfaces with the slider grooves 210*a* and 211*b* and guide grooves 210*b* and 211*b*. The protrusions engage rectangular windows formed in rising portions of the slide holders 201 with the channel shape to be fastened to the slide holders 201. An engaging pin 202 is fixed to an end of the slide holder 201. A lower end of the engaging pin 202 engages a cam groove 287*a* formed in a shaft 287. A gear 286 is mounted to one side of the shaft 287. The other side of the shaft is rotatably supported by a support member (not shown).

The gear 286 receives a rotational drive force from a motor 280 through a gear 281 mounted to a motor shaft of the motor 280 capable of forward and reverse rotations, a gear 282 engaging a gear 281, and gears 283, 284, and 285. Accordingly, when the shaft 287 rotates in the forward and reverse directions, the slide holder 201 slides in the arrow directions A and B with the engaging pin 202 engaging the cam groove 287*a* (see FIG. 2). The slide holder 201 supports the sliders 210 and 211 in directions perpendicular to the advancing direction of the punches 250. A reference position detection piece 285A protrudes from the gear 285 engaging the gear 286 for detecting a reference position of the cam groove 287*a*, i.e., the reference position (RP) of the guide grooves 210*b* and 211*b* formed in the sliders 210 and 211. The RP detection piece 285A, i.e., the RP of the guide grooves 210*b* and 211*b*, is detected by a detection sensor 291.

A shaft-shaped rotating shaft 262 is arranged below the lower punch guide 230. A scrap box 270 is arranged below the rotating shaft 262 for storing punch scraps. A flapper 261 is mounted to the rotating shaft 262 to sweep and level a top portion of the punch scraps stored in the scrap box 270. One end of the rotating shaft 262 is mounted substantially in the central area of the rotating piece 275 to rotate the flapper 261. The other end of the rotating shaft 262 is rotatably supported by a support member (not shown). A bottom edge of the rotating piece 275 is bent into an L shape to form a detection piece 263 for detecting a position of the flapper 261. A rotating pin 275*a* protrudes from an upper side of the rotating piece 275 to rotate the rotating piece 275. The detection piece 263, i.e., the position of the flapper 261, is detected by a detection sensor 292. The detection sensor 292 is connected to a timer of the control unit 290.

Figure 6A:
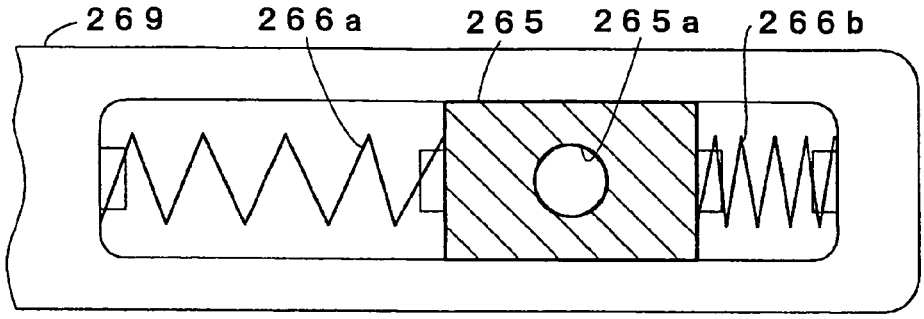
FIGS. 6(*a*) to 6(*c*) are schematic views showing a positional relationship of a slider spring and a sliding piece for rotating the flapper in the sheet punching apparatus according to the first embodiment of the present invention.
Figure 6B:
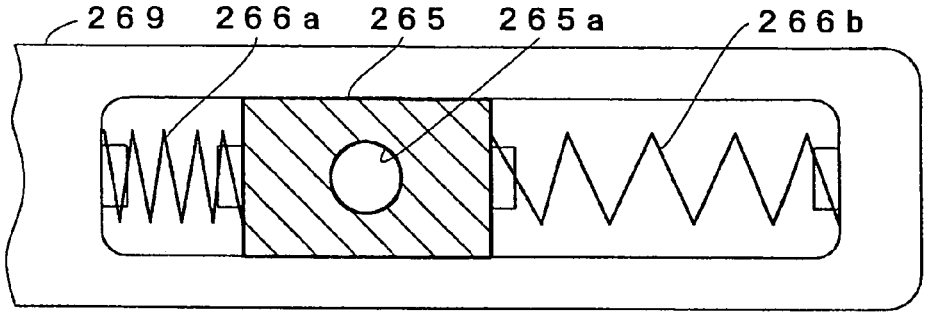
Figure 6C:
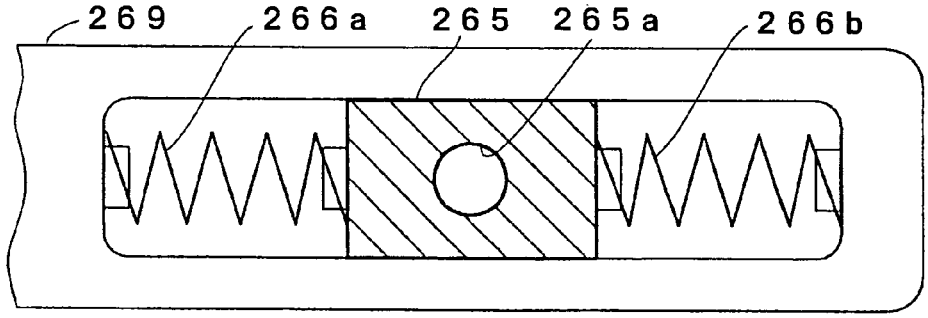

The rotating pin 275*a* is inserted into a circular penetration hole 265*a* in the slide piece 265 slidable inside a rectangular window 269*a* formed in one side of the slider 269 (see FIGS. 6(*a*) to 6(*c*)). The slider 269 is slidably supported in a sliding frame (not shown). Urging springs 266*a* and 266*b* are arranged with the sliding piece 265 in between for urging the sliding piece 265 inside the rectangular window 269*a* in opposite directions along the longitudinal direction. One end of the engaging pin 264 is mounted to the other side of the slider 269. The other end of the engaging pin 264 engages the cam groove 268*a* formed in the shaft 268. One side of the gear 268 is mounted to the pinion 267. The other side of the shaft is rotatably supported by a support member (not shown).

The pinion 267 engages a rack 205 supported on two support pins 204*a* and 204*b* mounted to one side of the falling portion of the slide holder 201. A rotational driving force of the motor 280 is transmitted to the rack 205 via the gears 281 to 286, a shaft capable of forward and reverse rotations, and the slide holder 201 moving in the arrow directions A and B in FIG. 2. Therefore, the motor 280, the gears 281 to 286, and the shaft 287 compose a common drive unit 289 having the drive source that drives the punches 250 described above and a portion (most) of the transmission path of the driving force.

Figure 3:
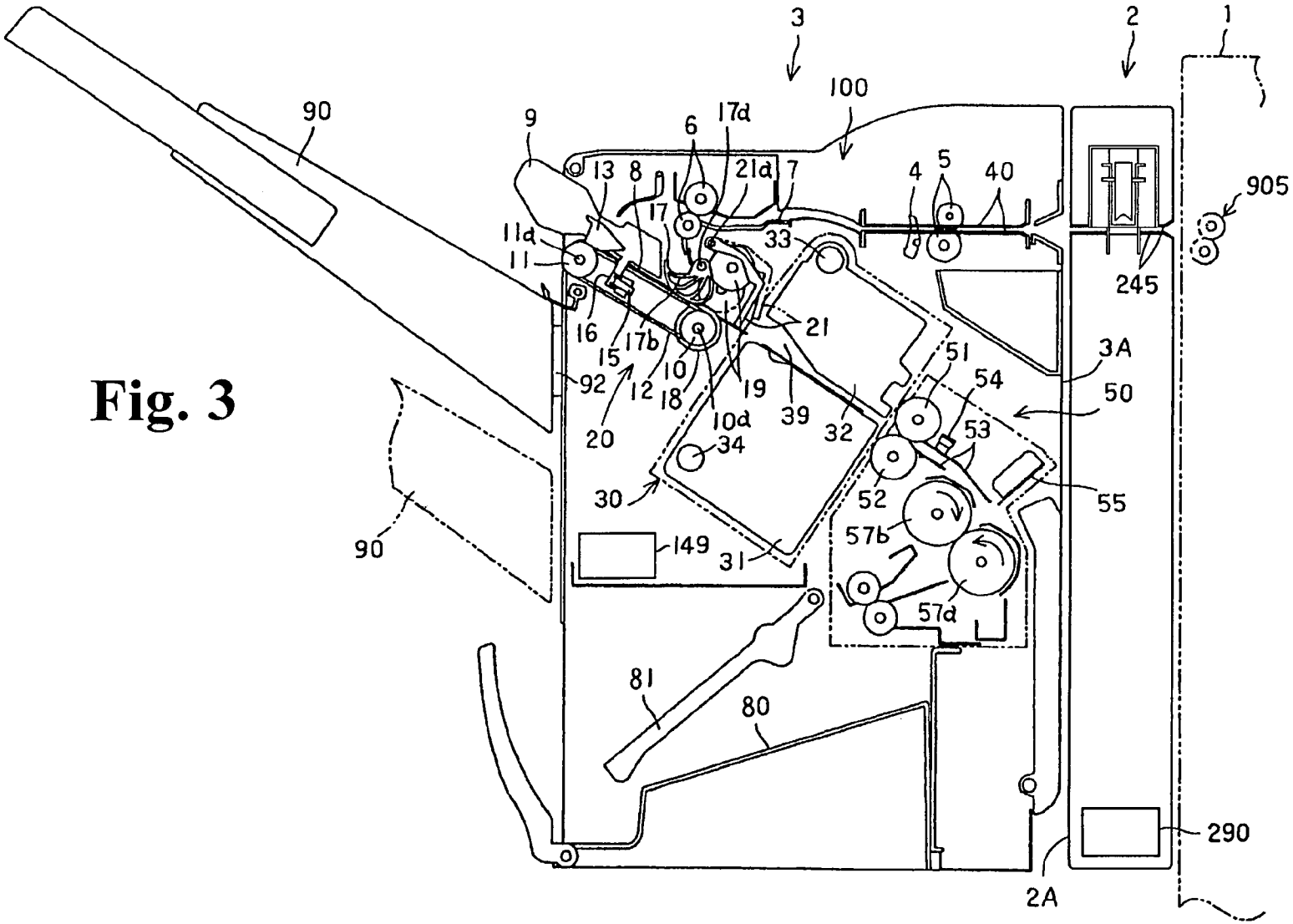
FIG. 3 is a front sectional view of the sheet punching apparatus and the sheet finishing apparatus according to the first embodiment of the present invention.

As shown in FIG. 3, the configuring members described above are stored in the apparatus frame 2*a*, i.e., a casing for the sheet punching apparatus 2. Furthermore, the sheet punching apparatus 2 comprises the control unit 290 that controls the entire sheet punching apparatus 2. The control unit 290 comprises a CPU (CPU2); ROM storing programs and program data executed by the CPU2; RAM as a work area for the CPU2 for storing setting data received from the control unit 950 on the copier unit 1A; and an interface for communicating between a timer circuit (timer) having a timer IC and a control unit 950 on the copier unit 1A. Note that the flapper 261, the scrap box 270, and the motor 280 shown in FIG. 2 are not shown in FIG. 3.

As shown in FIG. 3, in the apparatus frame 3A that is the casing of the sheet finishing apparatus 3, the sheet finishing apparatus 3 comprises a transport unit 100 that transports sheets discharged from the copier unit 1A to the opposite side of the pair of discharge rollers 905 substantially horizontally via the sheet punching apparatus 2; an aligning unit 20 arranged obliquely on the lower side of the transport unit 100 for aligning the edges of sheets; a stapler unit 30 arranged obliquely at a downstream side of the aligning unit 20 for binding a plurality of sheets; a folding unit 50 arranged obliquely at a downstream side of the stapler unit 30 for folding a stack of sheets at a predetermined folding position; a stacking unit for stacking the sheet stacks or booklets (folded sheet stacks); and a control unit 149 for controlling each of the units of the sheet finishing apparatus 3.

The transport unit 100 comprises a transport guide 40 that guides the sheets into the sheet finishing apparatus 3; a transport guide 7 that guides the sheets further downstream; a pair of transport rollers 5 arranged in the transport guide 40 to nip and transport the sheets; a sheet detection sensor 4 to detect a leading edge of the sheets transported in the transport guide 40; and a pair of discharge rollers 6 arranged at a furthest downstream side in the transport guide 7 to nip and discharge the sheets.

The aligning unit 20 comprises a processing tray 8 for stacking the sheets discharged by the pair of discharge rollers 6. The processing tray 8 is obliquely arranged at approximately 30 degrees to the platen 906 on the copier unit 1A with the sheet transport direction as a lower side to urge the transport of sheets to the downstream side of the sheets. The processing tray 8 has an alignment plate 9 for guiding both sides of the sheet for alignment in a width direction. An aligning motor (not shown) is disposed on a lower position of the processing tray 8. The pinion 15 engages the rack 16 and a shaft of the aligning motor. An elongated thin fastening member extends from a lower side of the aligning plate 9. A leading end of the fastening member is fastened to the rack 16 penetrating an oblong hole formed in the processing tray 8 in the width direction. Therefore, the aligning plate 9 moves with the rotation of the aligning motor in the width direction of the processing tray 8 according to the size of the sheet.

The pulleys 10 and 11 engage the pulley shafts 10*a* and 11*b* in the lower central area of the processing tray 8. An endless transport belt 12 is placed between the two pulleys 10 and 11. To the pulley shaft 10*a* is mounted a lower transport roller 18. An outer circumference of the lower transport roller 18 is exposed above a top surface through a slit formed in the processing tray 8. A drive force is transmitted to the pulley shaft 10*a* from a stepping motor (not shown) that is capable both forward and reverse rotations.

An upper transport roller 19 is arranged above the lower transport roller 18. The upper transport roller 19 moves between a contact position where it touches the lower transport roller 18 as represented by hidden lines in the drawing, and a separated position where it is separated from the lower transport roller 18 represented by the solid line in the drawing. The upper transport roller 19 moves through an action of a cam or the like (not shown) between the contact position and the separated position. The stepping motor rotates the upper transport roller 19 through gears (also not shown).

The paddle 17 rotates around the shaft 17*a* to urge the sheets in the sheet transport direction, and is disposed below the transport guide 7 and above the processing tray 8. The paddle 17 is formed of an elastic material such as rubber having elasticity, and includes integrally formed fins 17*b* radially extending from the shaft 17*a* as the center thereof. When the sheets are discharged and stacked on the processing tray 8, the paddle 17 is easily deformed, thereby providing an appropriate urging force to the sheets in the sheet transport direction.

A pushing pawl 13 is mounted to the endless transport belt 12. An edge of the pushing pawl 13 abuts against a side of the sheet stack stacked on the processing tray 8, and pushes the sheet stack to the elevator tray 90. The pushing pawl 13 has a home position (HP) where an edge of the pushing pawl 13 is located directly below the pulley shaft 10*a*. A detector arm engaging the pushing pawl 13 and an arm detector sensor formed of an integrated transmission type sensor are arranged below the endless transport belt 12 to detect the HP of the pushing pawl 13.

Furthermore, a stopper 21 is arranged above the stapler unit 30. The stopper 21 restrains and aligns the edges of the sheets while they fall under their own weight onto the obliquely arranged processing tray 8 and are urged further downwardly in the sheet transport direction by the rotation of the paddle 17. The stopper 21 has a J-shaped cross section having an arm portion and a leg portion. One end of the arm of the stopper 21 is mounted to a plunger of a solenoid 22 (not shown) and the other end of the arm is pulled by a spring 23 with a predetermined force. In response to an operation of a solenoid (not shown), the stopper 21 pivotally moves around a support shaft located at substantially the center of the arm between a restraining position where a bottom surface of the leg (leading edge of the leg) abuts against a top surface of the processing tray 8 as represented by the solid line in the drawing and a retraction position where the stopper 21 is separated from the top surface of the processing tray 8 as represented by the hidden lines.

The pushing pawl 13 is normally (when the upper transport roller 19 is at the separated position, and the stopper 21 is in the retraction position) movable to the elevator tray 90 side. Therefore, it is possible to transport the sheet stack with the edge aligned by the stopper 21 positioned at the restraining position to the elevator tray 90 using the pushing pawl 13, and to nip the sheet stack with the edge aligned by the upper transport roller 19 positioned at the contact position of the lower transport roller 18 when the pushing pawl 13 is at the HP.

The stapler unit 30 is arranged at a downstream side of the aligning unit 20, and includes a head assembly 31 and an anvil assembly 32. The head assembly 31 has a staple cartridge below a transport path 39 that transports the sheet stacks for driving staples. The anvil assembly 32 is located above the transport path, and receives and folds the leading ends of staples driven from the head assembly 31. The stapler unit 30 has a function for binding the edges or the central position of the sheet stack corresponding to a distance of transport of the sheet stack nipped and transported by the lower transport roller 18 and the upper transport roller 19. The stapler unit 30 can staple the sheet stack at a plurality of locations via pillar-shaped guide rods 33 and 34 that support and guide a head assembly 31 and an assembly 32 in a direction intersecting the transport direction of the sheet. Note that the stapler unit 30 is constructed in a unit as represented by the hidden lines in the drawing. It can be pulled from the sheet finishing apparatus 3 so that staples can be replenished.

The folding unit 50 is constructed in a unit represented by the hidden lines, and is arranged at a downstream side of the stapler unit 30. Like the stapler unit 30, the folding unit 50 is also detachable from the sheet finishing apparatus 3.

The upper stack transport roller 51 and the lower stack transport roller 52 are arranged at an entrance of the folding unit 50 to nip and transport the sheet stacks further downstream. A stack transport guide 53 is arranged at a downstream side of the upper stack transport roller 51 and the lower stack transport roller 52 to guide the sheet stack transported by the pair of rollers further downstream. An edge detector sensor 54 formed of an integrated emitter-receptor type sensor for detecting a leading edge of the sheet stack is arranged in the sheet stack transport path of the stack transport guide 53. In response to a signal detection of the leading edge of the sheet stack from the edge detector sensor 54, a control unit 149 controls the upper stack transport roller 51 to contact the lower stack transport roller 52 while setting a folding position of the sheet stack in the sheet transport direction.

The upper stack transport roller 51 moves between a position (represented by a solid line) where the upper stack transport roller 51 is pressed against the lower stack transport roller 52 and a spaced position (not shown) where the upper stack transport roller 51 is separated from the lower stack transport roller 52. The upper stack transport roller 51 remains away from the lower stack transport roller 52 until the edge detector sensor 54 detects the leading edge of the sheet stack, and the two rollers 51 and 52 are pressed against each other when the edge detector sensor 54 detects the leading edge of the sheet stack. At substantially the same time as the rollers are pressed into contact with each other, the upper transport roller 19 moves away from the contact position to the separated position. The upper stack transport roller 51 and the lower stack transport roller 52 are pressed against each other to continue transporting the sheet stack further downstream.

A pair of folding rollers 57*a* and 57*b* that is rotatably driven is arranged below the transport guide 53. The rollers are pressed against each other in a direction perpendicular to the sheet stack transport direction to fold the sheet stack. A pushing plate 55 is arranged at a downstream side of the transport guide 53 in a direction perpendicular to the sheet stack transport direction. A leading edge of the pushing plate 55 moves close to the contact position of the folding rollers 57*a* and 57*b* to push the sheet stack into the contact position between the folding rollers 57*a* and 57*b*.

The folding unit 50 folds the sheet stack at a position half way from the leading edge of the sheet stack (in center of the sheet stacks) when the sheets are fed in the length direction. A folded sheet stack discharge stacker 80 that stacks the sheet stacks folded by the folding unit 50 is disposed at a downstream side of the folding unit 50 at a bottom of the sheet finishing apparatus 3. The discharge stacker has an inclined surface opposite to those of the aligning unit 20, the stapler unit 30 and the folding unit 50. A folded sheet pusher 81 with one end thereof rotatably supported is arranged above the folded sheet stack discharge stacker 80. The folded sheet pressure member 81 folds and presses the discharged sheet stack using an urging force of a spring or the like in cooperation with the force of gravity of the sheet stack along the inclined surface of the folded sheet stack discharge stacker 80.

An elevator tray 90 that is capable of rising and lowering in the vertical direction is arranged on a sidewall of the apparatus frame 2A at a side opposite to the sheet punching apparatus 2. The elevator tray 90 is supported by the elevator tray support unit 92.

A control unit 149 includes a CPU (CPU3); ROM prerecorded with a program to be executed by the CPU3 and program data in advance; a RAM as a work area of the CPU3 for storing setting data received from a control unit 950 in the copier 1A; and an interface.

The following describes an operation of the copier 1A according to the present embodiment. An original D is set in the ADF 940. An operator inputs a change in a setting displayed on the touch panel 248 or makes a setting. When a start button on the touch panel 248 is pressed, the CPU1A loads all setting information of the digital copier 1A from the touch panel control unit 250. The following describes a mode for punching two or three holes in a sheet according to the invention.

The CPU1A loads the image data read by the image input unit 930 via the A/D converter and sequentially stores the data in the hard disk. The CPU1A sends setting information relating to the sheet punching apparatus 2 and the sheet finishing apparatus 3 to each of the control units 290 and 149. Then, an image is formed on the sheet at the image forming unit 902 according to the image data stored in the hard disk.

Specifically, the CPU1A outputs a paper feed signal to the paper feeding apparatus 909 to feed the sheet with a specific size. The control unit on the paper feeding apparatus 909 feeds the sheet from a specified cassette by driving a pair of rollers to rotate. The pair of rollers corrects any skew of the sheet, and feeds the sheet to the image forming unit 902 at an adjusted timing. The CPU1A controls the laser unit 922 to irradiate the image data of the sheet to the photoconductive drum 914 by a single line. The primary charging unit 919 charges the photoconductive drum 914 in advance, so that an electrostatic latent image is formed on the photoconductive drum 914. The developer 915 develops the electrostatic latent image to form a toner image on the photoconductive drum 914.

In the image forming unit 902, the electrostatic charger 916 transfers the toner image on the photoconductive drum 914 to the sheet. The separating charging unit 917 charges the sheet with the toner image with polarity opposite to that of the transfer unit 916, so that the sheet is separated from the photoconductive drum 914. The endless transport belt 920 transports the sheet separated from the photoconductive drum 914 to the fixing unit 904. The fixing unit 904 permanently fixes the transferred image onto the sheet, thereby forming (recording) the image on the sheet. In the duplex printing mode, an image is formed on the other side of the sheet via the duplex 921.

The pair of the discharge rollers 905 discharges the sheet with the image into the sheet punching apparatus 2 from the copier 1A. A sensor (not shown) is arranged at a downstream side of the pair of discharge rollers 905. After the sensor detects a leading edge of the sheet, the CPU1A rotates the pair of discharge rollers 905 by a predetermined number of steps, and then stops the sheet transport. Accordingly, a portion of the sheet to be punched stops in the transport space described above via the transport guide 245 inside the sheet punching apparatus 2. The CPU1A reports to the CPU2 that the sheet stops.

The CPU2 receives the report from the CPU1A and rotates the motor 280 according to the number of holes (2 or 3) set as reported from the CPU1A. Specifically, when the setting calls for two holes, the CPU2 rotates the motor 280 in the forward direction (clockwise) and moves the slide holder 201 in the arrow direction A shown in FIG. 2. When the setting calls for three holes, it rotates the motor 280 in the reverse direction (counterclockwise) and moves the slide holder 201 in the arrow direction B shown in FIG. 2. During initialization of the settings after turning on the apparatus, the CPU2 determines whether the detection sensor 291 detects the RP detection piece 285A. If the judgment is negative, the CPU2 activates the motor 280 until the detection sensor 291 detects the RP detection piece 285A to position the slide holder 201 at the reference position while initializing the settings.

Figures 4A, 4B, 4C:
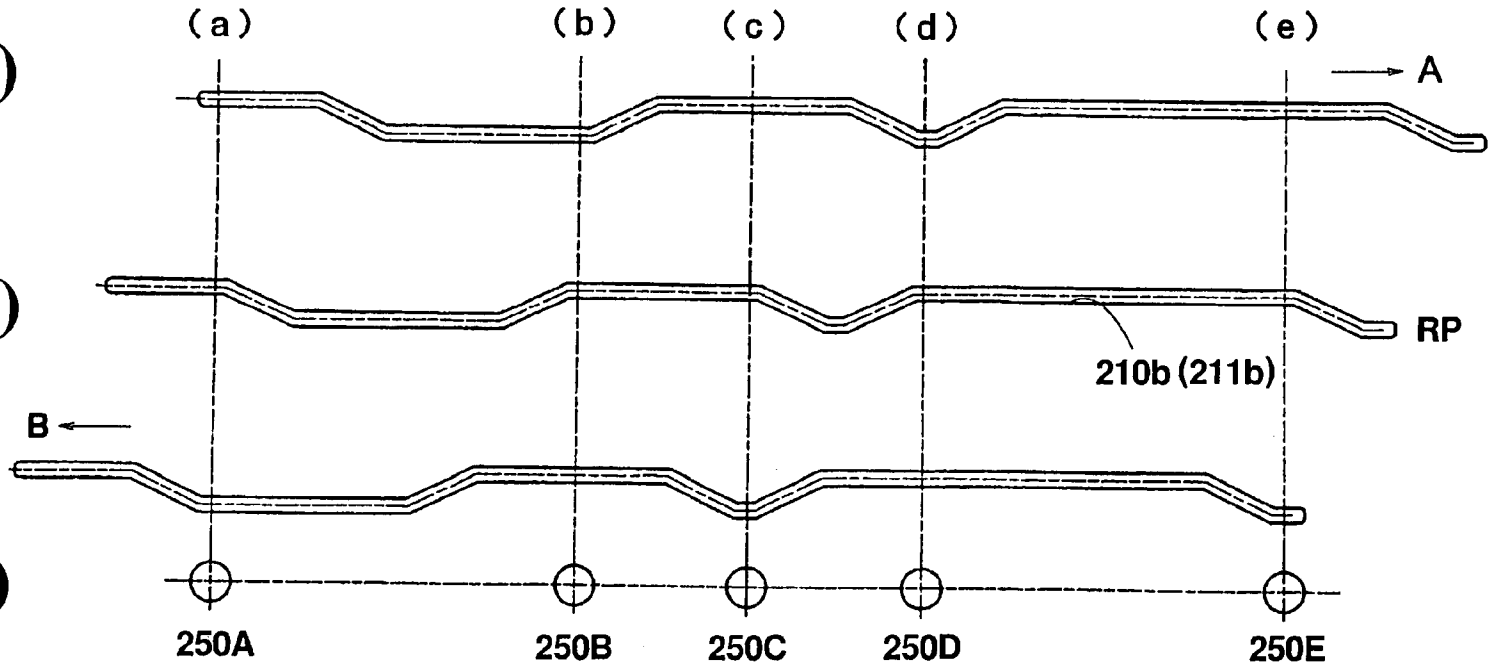
FIGS. 4(*a*) to 4(*c*) are schematic views showing a positional relationship of punches and a guide groove formed in a slider of the sheet punching apparatus according to the first embodiment of the present invention.

The following shall describe a relationship of the punches 250 and the guide grooves 210*b* and 211*b* with reference to FIGS. 4(*a*) to 4(*c*). As described above, the sliders 210 and 211 are mounted to the slide guide 201. Therefore, when the slide guide 201 is positioned at the reference position, the guide grooves 210*b* and 211*b* are also positioned at the PP. FIG. 4(*b*) is a schematic view showing the guide groove 210*b* (211*b*) in this state.

When the five punches 250 are arranged in the order of 250A, 250B, 250C, 250D, and 250E, and the activating pins 251 are arranged in the order of 251A, 251B, 251C, 251D, and 251E, from the motor 280 shown in FIG. 2, the punches 250A, 250B, 250C, 250D, and 250E at the RP are positioned at positions (a), (b), (c), (d), and (e) in FIG. 4(*b*), respectively. That is, in FIG. 4(*b*), the activating pin 251A engages at the position (a) in the guide groove 210*b* (211*b*) at the RP. Similarly, The activating pin 251B engages at the position (b); the activating pin 251C engages at the position (c); the activating pin 251D engages at the position (d); and the activating pin 251E engages at the position (e) in the guide groove 210*b* (211*b*) at the RP.

It should be noted that the engaging positions of the activating pins 251A to 251E in the guide groove 201*b* (211*b*) at the RP are located in the upper horizontal groove described above. Accordingly, the punching blades of the punches 250A to 250E are positioned at the retracted positions above the channel bottom portion 223 of the upper side punch guide 220 (see FIG. 3). When the punching process is not selected, it is possible to transport the sheet into the sheet finishing apparatus 3. In this case, the CPU1A does not stop the sheet, and transports the sheet into the sheet finishing apparatus 3 via the sheet punching apparatus 2.

The slider 210 (211) is mounted to the slide holder 201 as shown in FIG. 4(*a*). Accordingly, when the motor 280 rotates in the forward direction for a predetermined number of steps to move the slide holder 201 in the arrow direction A shown in FIG. 2, the guide groove 210*b* (211*b*) formed on the slider 210 slides for a predetermined distance from the RP in the arrow direction A. The activating pins 251A to 251E have small gaps, but are restricted by the pin penetration window 221*a* (222*a*) not to move in the arrow direction A with the sliding of the guide groove 210*b* (211*b*). Accordingly, as shown in FIG. 4(*a*), the activating pin 251A slides in the upper side horizontal groove to the position (a); the activating pin 251B slides in the lower horizontal groove to the position (b) from the upper horizontal groove via the inclined groove; the activating pin 251C slides in the upper horizontal groove to the position (c); the activating pin 251D slides in the lower horizontal groove to the position (d) from the upper horizontal groove via the inclined groove; and the activating pin 251E slides in the upper side horizontal groove to the position (e).

Specifically, the activating pins 251B and 251D are guided over the inclined grooves to the hole positions in the lower side horizontal groove. The punching blades of the punches 250B and 250D penetrate the circular penetration hole formed in the channel bottom portion 223 and the circular penetration hole 231*a* formed in the central flat portion 231. As a result, two holes are punched into the sheet. Note that the activating pins 251A, 251C and 251E slide in the upper horizontal groove, so that the punches 250A, 250C and 250E are held at the retracted positions.

When the CPU rotates the motor 280 in the reverse direction by a predetermined number of steps to move the slide holder 201 in the arrow direction B shown in FIG. 2, the guide groove 210*b* formed in the slider 210 (211) slides for a predetermined distance from the RP in the arrow direction B as shown in FIG. 4(*c*). The activating pins 251A to 251E are restricted by the pin penetration window 221*a* (222*a*) described above, and do not move in the arrow direction B with the sliding of the guide groove 210*b* (211*b*). Therefore, the activating pin 251A slides from the upper side horizontal groove to the position (a) in the lower side horizontal groove via the inclined groove; the activating pin 251B slides in the upper horizontal groove to the position (b); the activating pin 251C slides from the upper horizontal groove to the position (c) in the lower horizontal groove via the inclined groove; the activating pin 251D slides in the upper horizontal groove to the position (d); and the activating pin 251E slides from the upper side horizontal groove to the position (e) in the lower side horizontal groove via the inclined groove.

Specifically, the activating pins 251A, 251C, and 251E are guided over the inclined grooves to the hole positions in the lower side horizontal groove. The punching blades of the punches 250A, 250C and 250E penetrate the circular penetration holes in the channel bottom portion 223 and the circular penetration hole 231*a* formed in the central flat portion 231. As a result, three holes are punched into the sheet. Note that the activating pins 251B and 251D slide in the upper horizontal groove, and the punches 251B and 251D are held at the retracted positions.

In the embodiment of the present invention, the adjacent punches of the punches 250A to 250E have different combinations. The guide groove 210*b* (211*b*) is formed of the upper side horizontal groove, the lower side inclined groove, and the incline groove in the slider 210 (211), it is possible to use the punches 250 to punch two or three holes. Of the three grooves, the upper side horizontal groove functions to stop (retain) the punches 250 at the retracted positions as a retracting unit. The inclined groove functions as an advancing unit to advance the punches 250 to the hole punching positions. That is, the inclined groove unit has a function for applying a pressing force downwardly on the punches 250 through the engagement with the activating pins 251. The lower side horizontal groove functions as a moderator for the punches 250 at the bottom edge of the hole punching position. The activating pins 251 engage the guide groove 210*b* (211*b*), so that the five punches 250 are movably supported by the slider 210 (211) between the retracted positions and the hole punching positions.

As described above, the driving force of the motor 280 is transmitted from the shared drive unit 289 to the slide holder 201 and is transmitted to the punches 250. It is also transmitted to the pinion 267 via the rack 205 that is supported by the support pins 204*a* and 204*b* by the movement of the slide holder 201. The slider 269 moves via the engaging pin 264 by the rotation of the pinion 267. The rotating piece 275 rotates around the rotating shaft 262 via the rotating pin 275*a*. The flapper 261 mounted to the rotating shaft 262 sweepingly moves over the top portion of the punch scraps stored in the scrap box 270 to level the punch scraps. Therefore, the punches 250 and the flapper 261 operate in an overlapped manner.

Figure 5A:
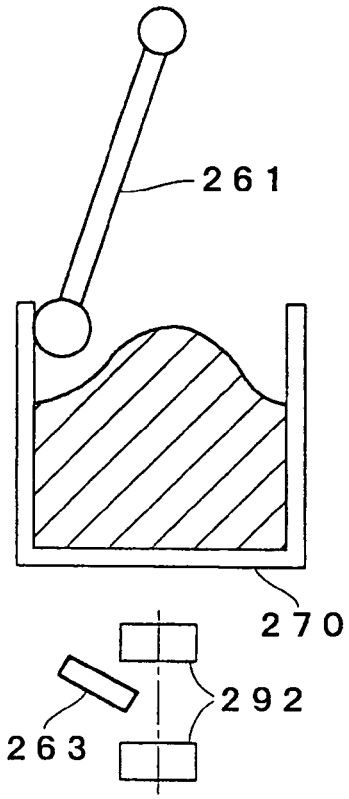
FIGS. 5(*a*) to 5(*c*) are schematic views showing a positional relationship of a flapper and a detection sensor relative to punch scraps stored in a scrap box in the sheet punching apparatus according to the first embodiment of the present invention.
Figure 5B:
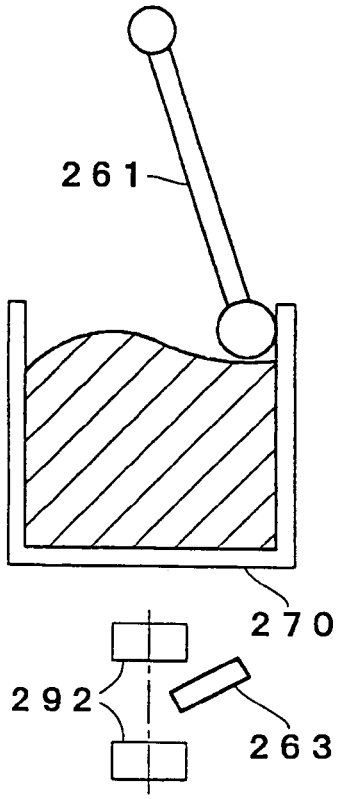
Figure 5C:
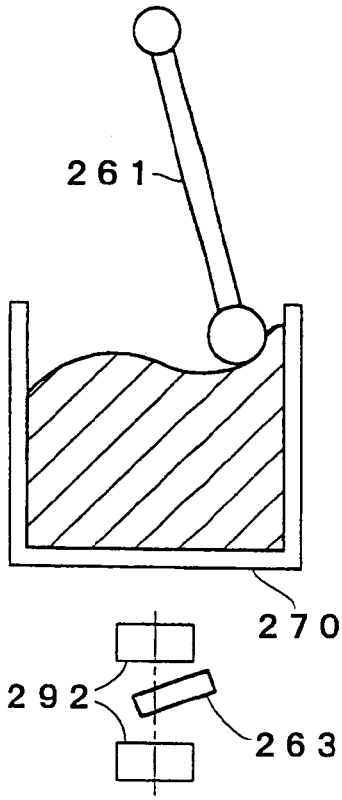

As shown in FIGS. 5(*a*) and 5(*b*), the flapper 261 moves from a position where it touches the inner wall of the scrap box 270 to a position where it touches the inner wall on the opposite side thereof. The detection piece 263 moves to a position away from the center of detection range of the detection sensor 292 (represented by the projected line in FIGS. 5(*a*) to 5(*c*)). Accordingly, the detection piece 263 may be located at a position the detection sensor 292 does not detect. As shown in FIG. 5(*c*), when the scrap box 270 becomes almost full, the punch scraps are sandwiched between the inner wall of the scrap box 270 and the flapper 261. Accordingly, the flapper 261 can not move to the position where it touches the inner wall of the scrap box 270. As a result, the detection sensor 292 continuously detects the detection piece 263 while the flapper 261 keep sweeping. Therefore, the detection sensor 292 detects the detection piece 263 to determine the position of flapper 261, thereby detecting that the scrap box 270 is full.

When the detection sensor 292 detects the detection piece 263, the detection sensor 292 outputs a detection signal (for example, a high level signal) to a timer. The timer starts the time count for preset time (for example, five seconds). After the preset time, the high level signal is sent to the CPU2. Accordingly, the CPU2 detects that the scrap box 270 is full. The detection piece 263 may be located outside of the center line of the detection sensor 292. In this case, as shown in FIGS. 5(*a*) and 5(*b*), the detection sensor 292 detects that the scrap box 270 is not full. When the detection sensor 292 detects continuously the detection piece 263 for the preset time, the scrap box 270 is detected to be full.

The CPU2 reports to the CPU1A on the copier 1A when the scrap box 270 is detected to be full. The CPU1A displays on the touch panel 248 that the scrap box becomes full and stops the sheet transport, and reports to the CPU3 to stop the operation of the sheet finishing apparatus 3. When the operator closes a front panel door (not shown) of the sheet punching apparatus 2 after opening it (according to a signal from an opening sensor or a contact sensor; not shown), the CPU2 determines whether the signal from the timer is a low signal. If the judgment is negative, the CPU2 reports to the CPU1A again that the scrap box is full. If the judgment is affirmative, the CPU2 reports to the CPU1A that the status is normal (the scrap box is not full). The CPU1A turns off the display on the touch panel 248 that the scrap box is full and restarts the normal operation, and restarts the operations by reporting to the CPU3. Note that the detection of the scrap box 270 is performed when the sheet punching apparatus 2 is turned on and the settings are initialized. Because this is reported to the CPU1A, the operator can view the touch panel before starting copying using the copier 1A to ascertain whether the scrap box 270 is full.

The urging forces of springs 266*a* and 266*b* disposed inside the rectangular window 269*a* in the slider 269 are applied to the flapper 261. As shown in FIG. 6(*c*), when the slider 269 is not moving, the urging forces of the springs 266*a* and 266*b* are balanced, so that the slide piece 265 is positioned at substantially the center of the rectangular window 269*a*. The flapper 261 moves smoothly when only a small amount of the punch scraps is in the scrap box 270. Accordingly, the slide piece 265 is held at the position substantially the center of the rectangular window 269*a*.

As the punch scraps increase, they hinder the movement of the flapper 261. At this time, as shown in FIG. 6(*a*), when the slider 269 moves in the arrow direction D in FIG. 2 (the slide holder 201 moves in the arrow direction B), the spring 266*b* contracts and urges the slide piece 265 in the direction of the spring 266*a*. The urging force of the spring 266*b* moves the slide piece 265 to rotate the flapper 261. When the spring 266*b* is released, the slide piece 265 is positioned where the urging force of the springs 266*a* and 266*b* is balanced at the position shown in FIG. 6(*c*). When the slider 269 moves in the arrow direction C in FIG. 2 (the slide holder 201 moves in the arrow direction A), the urging force of the spring 266*a* urges the slide piece 265 to move, thereby rotating the flapper 261, as shown in FIG. 6(*b*).

The CPU2 rotates the motor 280 in the forward or the reverse direction, and after punching two or three holes in the sheets, it rotates the motor 280 by a predetermined number of steps in the reverse or the forward direction. The CPU2 judges whether the detection sensor 291 has detected the RP detection piece 285A. When the judgment is affirmative, it stops the motor 280. If the judgment is negative, it rotates the motor 280 in the reverse or the forward direction until the detection sensor 291 has detected the RP of the detection piece 285A, then stops the rotation of the motor 280. It then reports to the CPU1A that the motor 280 has stopped. In other words, by rotating the motor 280 in the reverse or the forward direction by a predetermined number of steps, the guide groove 210*b* (211*b*) of the slider 210 (211) is positioned at the RP, and the punches 250 advanced into the hole punching positions are positioned at the retracted positions. Accordingly, the sheet passes through the transport space without being inhibited by the punches 250 advanced into the transport space. At this time, the flapper is positioned where the urging force of the springs 266*a* and 266*b* are balanced.

Upon a report from the CPU2, the CPU1A rotates the pair of discharge rollers 905. It stops the pair of discharge rollers 905 when a sensor (not shown) arranged at a downstream side of the pair of discharge rollers 905 detects the trailing edge of the sheet. This transports the sheet to the sheet finishing apparatus 3.

The CPU3 moves the head assembly 31 and the anvil assembly 32 to the initialized positions when it receives the setting information relating to the sheet finishing apparatus 3, and idles until the sheet is discharged from the copier 1A via the sheet punching apparatus 2. The operation of the sheet finishing apparatus 3 for the setting modes will be described below.

Upon the setting information for a non-stapling mode from the CPU1A, the CPU 3 drives a stepping motor (not shown) to move the pushing pawl 13 from the HP described above to the pre-home position (pre-HP) near the elevator tray 90 for a predetermined distance from where the pushing pawl 13 is directly above the pulley shaft 10*a*, i.e., the sheet stacking reference. At this time, the upper transport roller 19 is at the separated position, and the stopper 21 is at the retraction position. Note that the movement from the HP to the Pre-HP can be conducted by counting the number of pulses sent to the stepping motor.

In parallel to this, the sheet finishing apparatus 3 idles until the drive rollers for the pair of transport rollers 5, and the pair of discharge rollers 6 is rotated to discharge the sheet from the copier 1A. When the sheet is discharged, the pair of transport rollers 5 and the pair of discharge rollers 6 transport the sheet to the processing tray 8. When the sheet detector sensor 4 detects the sheet, the CPU3 measures a start timing of the alignment motor to move the alignment plate 9 and paddle motor 165 to rotate the paddle 17.

When the sheet is discharged into the processing tray 8, the alignment motor and paddle motor are driven. In response, the alignment plate 9 moves in the width direction perpendicular to the sheet transport direction to align both edges of the sheet. The paddle 17 rotates so that the edge of the sheet is aligned along the end of the pushing pawl 13 situated at the pre-HP position. These steps are repeated every time the sheet is discharged into the processing tray 8.

When a predetermined number of the sheets is aligned along the edge of the pushing pawl 13, the transport motor and paddle motor are stopped. The stepping motor (not shown) is activated to move the endless transport belt 12, so that the edge of the pushing pawl 13 pushes the sheets toward the elevator tray 90. Accordingly, the sheet stack is stacked in the elevator tray 90. When the sheet stack is placed on the elevator tray 90, an elevator tray motor (not shown) rotates to lower the elevator tray 90 for a certain distance. Then, the elevator tray motor rotates in the reverse direction, thereby raising the elevator tray 90 to a position to idle at the position until the next sheet stack is placed thereupon.

Therefore, in the non-stapling mode, which does not require the stapling process, the pushing pawl 13 is positioned at the pre-HP position in advance to stack the sheet stack and push the sheet stack toward the elevator tray 90 without moving the sheet to the restraining position of the stopper 21. Thus, even if a sheet discharge rate of the copier 1A is high, the sheet finishing apparatus 3 that is not punching holes in the sheets can keep up with the discharge rate.

When the edge stapling mode setting information is received from the CPU1A, the CPU3 positions the stopper 21 at the restraining position with a solenoid (not shown) turned on. It rotates the drive rollers of the transport rollers 5 and the pair of discharge rollers 6 to discharge the sheet into the processing tray 8 from the copier apparatus 1A. The alignment motor and paddle motor are then driven. The both sides of the sheet in the width direction are aligned along the alignment plate 9, and the stopper 21 stops the sheet after reaching a sidewall of a leg of the stopper 21. This step is repeated for a predetermined number of times, so that the sheet stack is aligned and restrained by the stopper 21.

Next, while the sheet stack is in the restrained state by the stopper 21, the upper transport roller 19 moves toward the lower transport roller 18 to nip the sheet stack. Then, the solenoid (not shown) is turned off, and the stopper 21 moves to the retraction position. The stepping motor (not shown) drives by a predetermined number of steps in a direction opposite to that in the non-finishing mode. Through this drive, the upper transport roller 19 and lower transport roller 18 nip and transport the sheet stack toward the stapler unit 30 until the stapling position of the sheet stack reaches a head position of the head assembly 31 located at the initial position. Note that a one-way clutch (not shown) is interposed between the pulley shaft 10*a* and the pulley 10 around which the endless transport belt 12 is entrained. Therefore, when the stepping motor (not shown) rotates in the reverse direction in this way, the rotation of the stepping motor is not transmitted to the endless transport belt 12, and the endless transport belt 12 and pushing pawl 13 remain stopped.

Next, the stapling operation is performed on the edge of the sheet stack by the head assembly 31 and anvil assembly 32. Note that when the stapling operation is performed on the sheet edge at a plurality of positions, the stapler unit 30 moves before the stapling operation.

When the stapling operation is completed, the stepping motor (not shown) drives the lower transport roller 18, the upper transport roller 19, and the endless transport belt 12 to send the sheet stack toward the elevator tray 90. Accordingly, after the stapling operation, the sheet stack is handed over to the pushing pawl 13 from the lower transport roller 18 and upper transport roller 19. The pushing pawl 13 pushes the sheet stack to place on the elevator tray 90 to be stacked thereupon. The remaining operation of the elevator tray 90 is the same as that in the non-finishing mode, thus an explanation thereof is omitted.

When the center stapling and folding process mode setting information is received from the CPU1A, the sheet discharged from the copier 1A is stacked on the processing tray 8 in the same way as that in the edge staple processing mode. After the sheet stack is aligned and stacked on the processing tray 8, the upper transport roller 19 is lowered toward the lower transport roller 18 to nip the sheet stack. At the same time, the solenoid (not shown) is turned off, and the stopper 21 moves to the retracted position. The stepping motor (not shown) rotates in a direction opposite to that in the non-stapling mode. The sheet stack, while being nipped between the upper transport roller 19 and lower transport roller 18, is transported to the stapler unit 30.

When the edge detector sensor 54 detects the leading edge of the sheet stack after the start of transport of the sheet stack, the CPU3 transports the sheet stack according to the information regarding the length of the sheet received from the CPU1A in the sheet transport direction, until the center of the sheet in the sheet transport direction reaches the stapling position. Then, the stepping motor (not shown) stops at which point the center of the sheet stack in the sheet transport direction undergoes the stapling process.

The upper transport roller 19 moves to the spaced position to disengage the sheet stack to perform the folding process. The transport motor 162 is activated to rotate the upper stack transport roller 51 and lower stack transport roller 52 to send the sheet stack further in a downstream direction. During the transport, the CPU3 decelerates and then stops the transport of the sheet stack in accordance with a signal detected by the edge detector sensor 54 and the sheet length information stored in the RAM, so that a center point of the sheet stack in the sheet transport direction, i.e., the stapling point, becomes the folding position.

Next, the folding rollers 57*a* and 57*b* rotate in a direction to nip the sheet stack, and at the same time, the pushing plate 55 is lowered. When the pushing plate 55 is lowered, the sheet stack is pulled in between the folding rollers 57*a* and 57*b*. The pushing plate 55 is then separated from the sheet stack, and the sheet stack is further pulled between the folding rollers 57*a* and 57*b* (i.e., transported in the nipped state). The sheet stack transported in the nipped state by the folding rollers 57*a* and 57*b* is then discharged into and stacked on the folded sheet stack discharge stacker 80.

After the start of the folding operation, when the pushing plate HP sensor (not shown) detects that the pushing plate 55 reciprocally moves a predetermined number of times according to the length of the sheet stack in the sheet transport direction, the CPU3 stops the operation of the folding unit 50.

When the folding process mode setting information is received from the CPU1A, the CPU3 executes the same process as the center stapling and folding process modes described above. The folding process mode differs from the center stapling and folding process mode in that it executes the folding process at the folding unit 50 without the stapling process at the stapler unit 30. For this reason, after the sheet stack edge has been aligned by the aligning unit 20, the CPU3 drives the stepping motor (not shown) in a direction reverse to that in the non-finishing mode to send the sheet stack to the stapler unit 30 while it is nipped by the upper transport roller 19 and the lower transport roller 18. To fold the sheet stack, the upper transport roller 19 is at the separated position to release the nip of the sheet stack. It activates the transport motor 162 to rotate the upper sheet stack transport roller 51 and the lower sheet stack transport rollers 52 to send the sheet stack to the folding unit 50. It executes the folding process at the folding unit 50 described above, and then discharges the sheet stack to the folded sheet stack discharge stacker 80 without stapling.

The following shall describe the action of the copier 1 according to this embodiment of the present invention focusing on the action of the sheet punching apparatus 2.

In the conventional sheet punching apparatus, the punch scraps move fluidly in a scrap box and become stacked in an uneven state. Because an optical sensor directly detects the uppermost portion of the uneven part, it is not possible to accurately detect when the scrap box is full because it erroneously detects a full state despite there is still a room left in the scrap box for more punch scraps.

In the sheet punching apparatus 2 according to this embodiment of the present invention, the detection sensor 292 detects the full status of the scrap box by detecting a position where the flapper 261 does not move because punch scraps are interposed between the flapper 261 that sweeps to level the top portion of the punch scraps and the inner wall of the scrap box 270.

For that reason, because the full status is detected according to the position of the flapper 261, it is possible to accurately detect that the scrap box is full even when the top portion of the punch scraps are unevenly stacked.

Also, in the conventional sheet punching apparatus, a scrap box is vibrated to level punch scraps, and an optical sensor directly detects the punch scraps. Accordingly, it is difficult to detect that the scrap box is full during the vibrations (leveling).

In the sheet punching apparatus 2 according to the embodiment of the present invention, the detection sensor 292 detects the position of the flapper 261 to detect that the scrap box 270 is full while leveling the top portion of the punch scraps by moving the flapper 261. For this reason, the vibration time for detection of a full state is reduced, and this prevents discrepancy of the detection position caused by vibrations. Therefore, it is possible to level the top portion of the punch scraps and detect the full status at the same time, making it possible to efficiently and accurately detect the full status of the scrap box.

Furthermore, in the embodiment of the present invention, the springs 266*a* and 266*b* are disposed on the slider 269 in the sheet punching apparatus 2 to rotate the flapper 261. For this reason, even if some resistance is generated by the punch scraps hindering the movement of the flapper 261 as the scrap box 270 nears the full point, the urging force of the springs 266*a* and 266*b* is applied to the flapper 261 to enable it to continue leveling the top portion of the punch scraps.

The scrap box 270 is arranged below the lower punch guide 230 to store the punch scraps in the sheet punching apparatus 2 in the embodiments of the present invention. The flapper 261 is disposed above the scrap box 270 to sweep the top portion of the punch scraps stored in the scrap box 270, and it is disposed below the lower punch guide 230. This arranges the punches 250 near the flapper 261. The driving force from the motor 280 is transmitted to the punches 250 and the flapper 261 that share the drive unit 289 that includes the drive source motor 280. For this reason, a large transmission path is unnecessary for transmitting drive force from the drive source for sheet transport in the copier and vibration for the scrap box like the prior art. Therefore, the flapper 261 is driven by the motor 280 that drives the punches 250, i.e., the closest drive source. Because a portion (most) of the transmission path of the drive force is shared, a more compact structure for the sheet punching apparatus 2 is attained, thereby enabling a more compact sheet punching apparatus.

Also, in the sheet punching apparatus 2 of the embodiment of the invention, the flapper 261 sweeps the top portion of the punch scraps stored in the scrap box 270 to level them. For this reason, a large amount of energy such as that in the prior art for moving or vibrating the entire scrap box is unnecessary to level the top portion of the punch scraps. Therefore, it is unnecessary to sweep all of the punch scraps. This suppresses energy consumption and enables the leveling of the top portion of the punch scraps while reducing the load applied to the motor 280. Furthermore, the punching process can continue without causing problems while driving the flapper 261 or driving the punches 250.

Still further, in the sheet punching apparatus of the embodiment of the present invention, with the movement of the slide holder 201, the drive force is transmitted to the flapper 261 from the rack 205 via the pinion 267. For this reason, the flapper 261 sweeps to level the top portion of the punch scraps while the punches 250 punch two or three holes in the sheets. Therefore, it is possible to level the punch scraps immediately after they are stored in the scrap box 270 and maintain them in a level state.

The following shall describe the second embodiment of the present invention as applied to a copier. In this embodiment, instead of the flapper 261 in the first embodiment of the present invention, a slide shaft is mounted to a rotating shaft 262 for driving. In this second embodiment, the same numbers are applied to the same members as those in the first embodiment, and the explanations thereof are omitted. Only different points shall be addressed.

Figure 7:
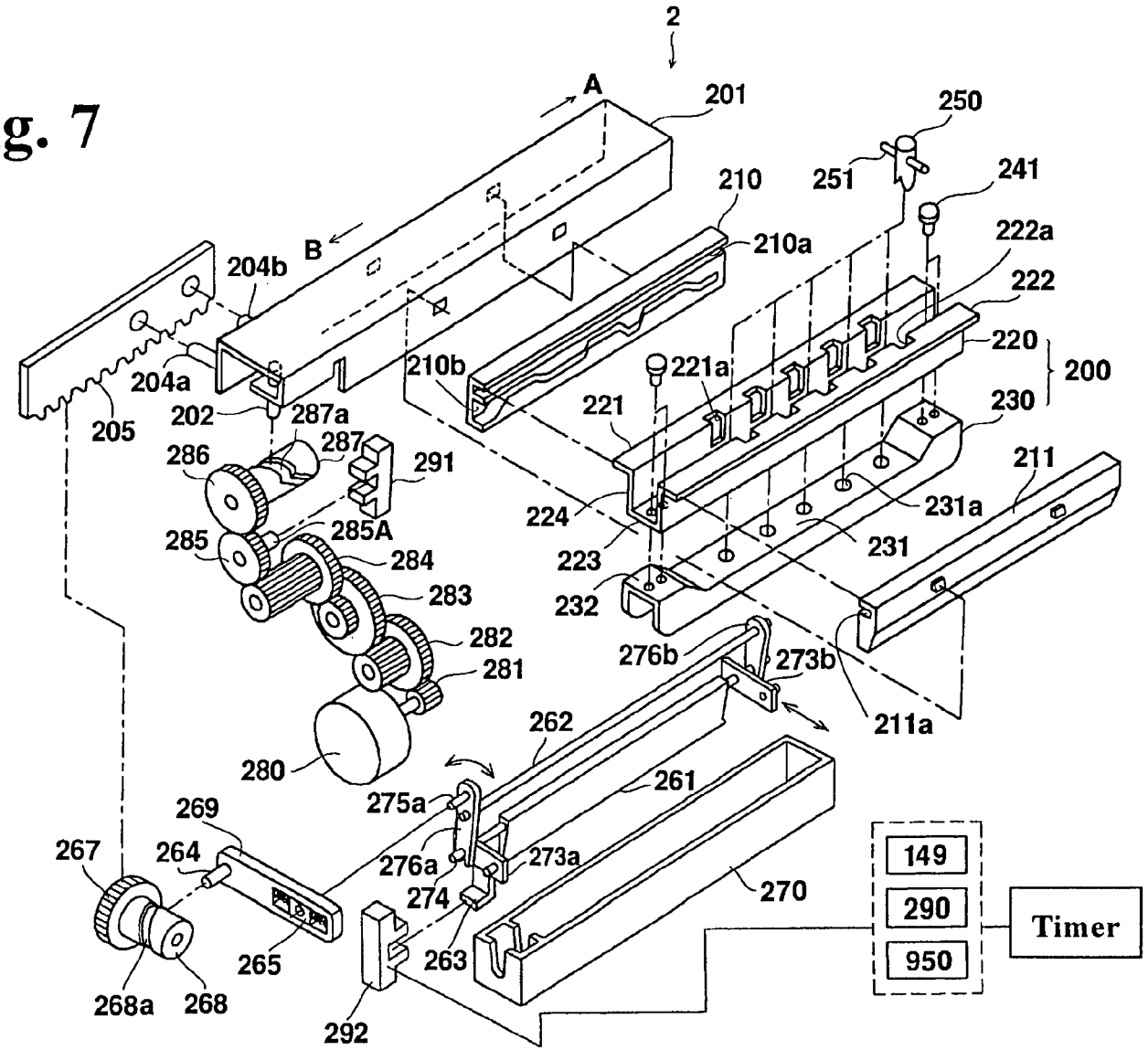
FIG. 7 is an exploded perspective view of a sheet punching apparatus according to a second embodiment of the present invention.

As shown in FIG. 7, the flapper 261 is mounted to a slide shaft 274 arranged above the scrap box 270. The sliders 273*a* and 273*b* are mounted to both ends of the slide shaft 274. Slide auxiliary pins are mounted on the other sides of each of the sliders 273*a* and 273*b*. The slide shaft 274 penetrating the sliders 273*a* and 273*b* and the slide auxiliary pins are slightly supported in a slide frame (not shown) arranged substantially horizontally. A substantially U-shaped notch portion formed on the bottom side of the rotating pieces 276*a* and 276*b* engages a protruding portion of the slide shaft 274 penetrating the sliders 273*a* and 273*b*. On substantially the center locations of both the rotating pieces 276*a* and 276*b* are mounted ends of the rotating shaft 262. The rotating pieces 276*a* and 276*b* are thus interlocked by the rotating shaft 262. The rotating pin 275*a* is mounted to the top end side of the rotating piece 276*a*.

The rotating pieces 276*a* and 276*b* rotate around the rotating shaft 262 via the rotating pin 275*a* by the movement of the slider 269. Also, the slide shaft 274 that engages the rotating pieces 276*a* and 276*b* moves in the direction opposite to that of the direction of movement of the slider 269. Therefore, the flapper 261 mounted to the slide shaft 274 moves to sweep the top portion of the punch scraps stored in the scrap box 270 to level them.

Figure 8C:
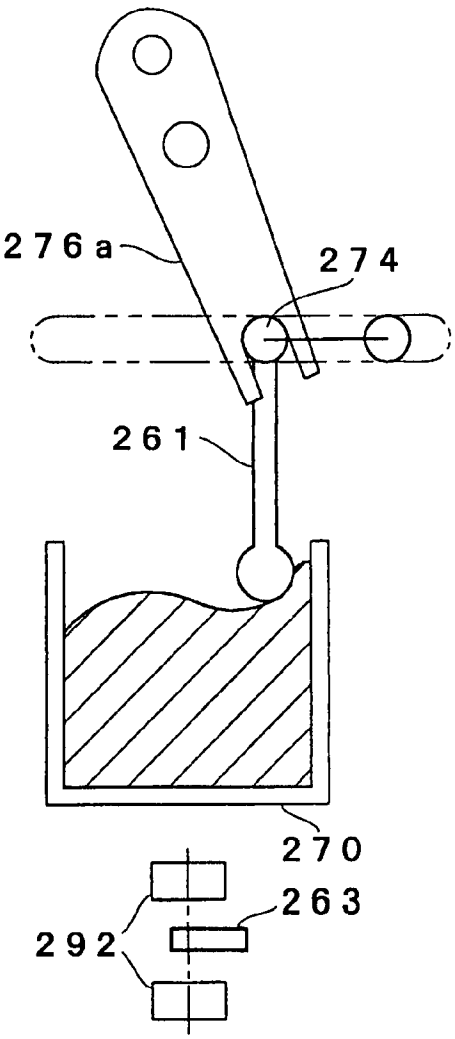
FIGS. 8(*a*) to 8(*c*) are schematic views showing a positional relationship of a flapper and a detection sensor relative to punch scraps stored in a scrap box in the sheet punching apparatus according to the second embodiment of the present invention.
Figure 8B:
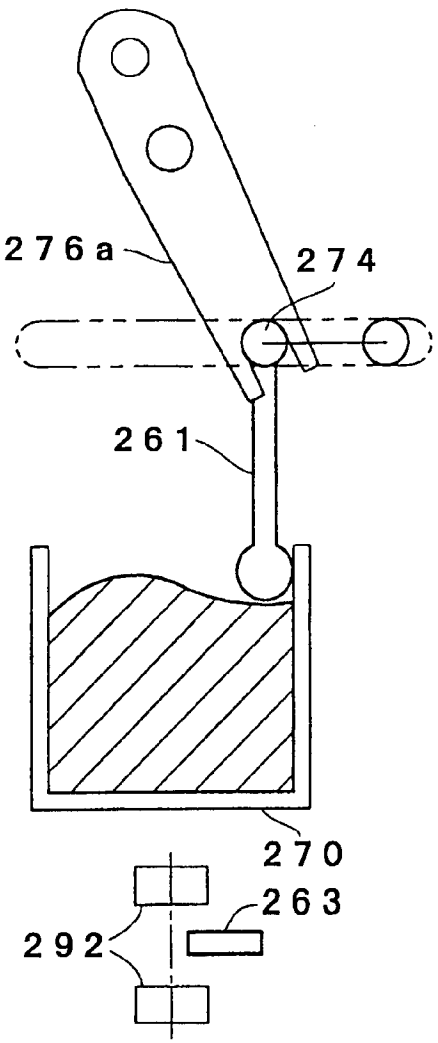
Figure 8A:
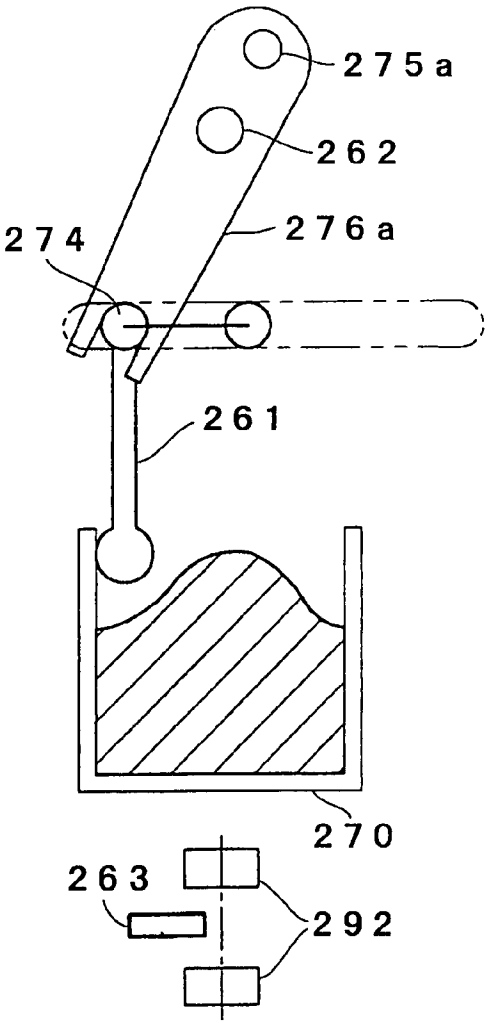

As shown in FIGS. 8(*a*) and 8(*b*), when the scrap box 270 is not full, the flapper 261 moves to positions to touch each of the opposing inner walls of the scrap box 270. Because the slide shaft 274 moves in the slide frame, the flapper 261 moves in a substantially horizontal direction along the slide frame (not shown), thereby making it possible to level the top portion of the punch scraps. At this time, the detection piece 263 also moves in a substantially horizontal direction. As shown in FIG. 8(*c*), as the scrap box 270 nears its full state, the detection piece 263 is positioned in the detection center substantially parallel to the detection sensor 292.

In the sheet punching apparatus 2 of this embodiment, the flapper 261 mounted to the slide shaft 274 moves in a substantially horizontal direction to level the top portion of the punch scraps. For this reason, the top portion of the punch scraps are substantially evenly leveled between the opposing inner walls of the scrap box 270, so that it is possible to ensure a storage space until the scrap box 270 becomes full. Furthermore, the detection piece 263 moves substantially parallel to the detection sensor 292, so that the detection piece 263 can be securely detected by the detection sensor 292.

The following shall describe the third embodiment of the present invention as applied to a copier. In this embodiment, instead of the pinion 267 and shaft 268 in the first embodiment of the present invention, a one-way clutch is employed to drive the flapper 261.

Figure 9:
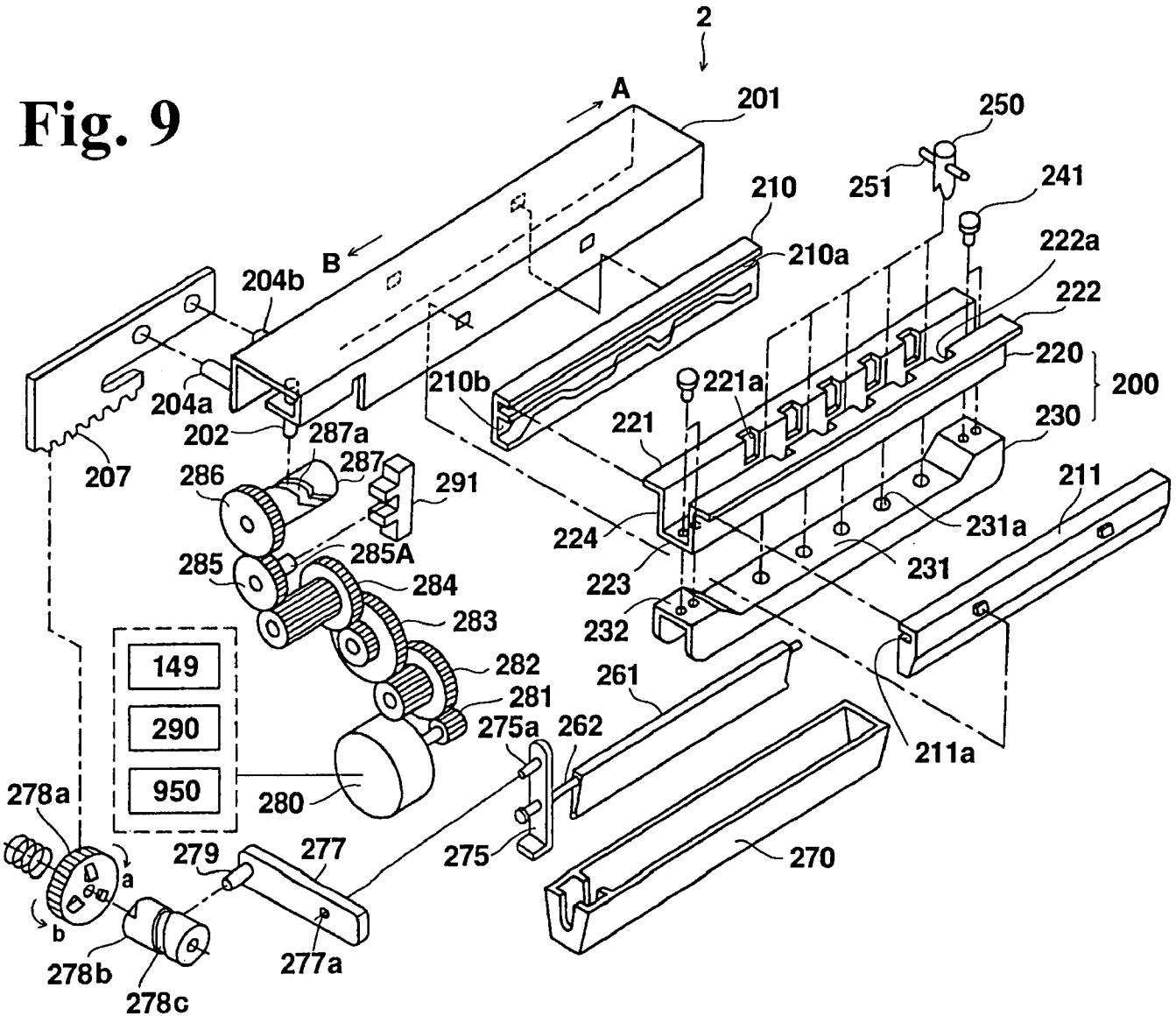
FIG. 9 is an exploded perspective view of a sheet punching apparatus according to a third embodiment of the present invention.

As shown in FIG. 9, the rotating pin 275*a* is inserted into the circular penetration hole 277*a* formed in one side of the slider 277. The slider 277 is slidably supported by a slide frame (not shown). The other side of the slider 277 is mounted to an end of the engaging pin 279. The other end of the engaging pin 279 engages the cam groove 278*c* formed in the shaft 278*b*. An end of the shaft 278*b* is rotatably supported by a support member (not shown). The other end of the shaft 278*b* is formed with substantially wedge-shaped notch portions at three locations in the edge portion of the outer surface.

Arranged on the other end of the shaft 278*b* is a gear 278*a* that has substantially wedge-shaped protrusions at three locations on the surface of the shaft 278*b* with the same central shaft. A spring member is arranged on the gear 278*a* on the opposite side of the shaft 278*b*. The gear 278*a* is urged in the direction of the shaft 278*b* by the spring member. The protrusions on the gear 278*a* engage the notched portions in the shaft 278*b* to allow the shaft 278*b* to rotate only in one direction. Therefore, the gear 278*a* and shaft 278*b* configure the one-way clutch 278.

A short rack 207 engages the gear 278*a*. The short rack 207 is supported on two support pins 204*a* and 204*b* mounted on one side of the falling portion of the slide holder 201. A torque meter (not shown) is connected to the drive source motor 280 to detect the load applied to the motor 280. The torque meter is connected to the CPU2 in the control unit 290 via the torque meter control unit. Note that the detection sensor 292 that detects the position of the flapper 261 is not provided.

Figure 10:
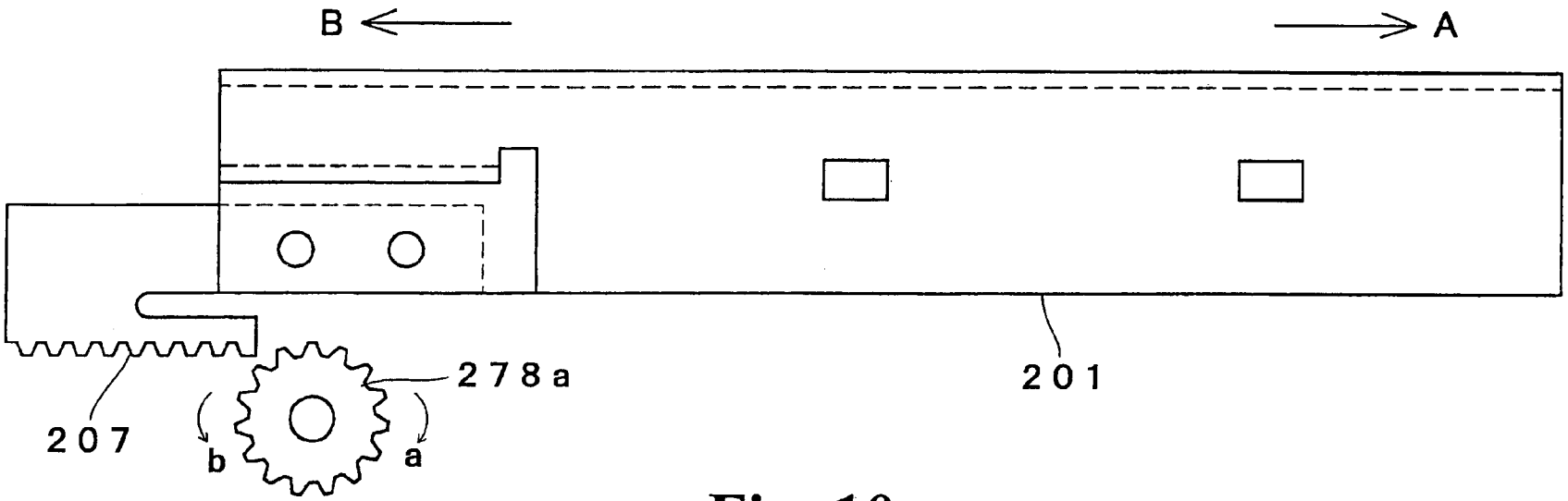
FIG. 10 is a schematic view showing a rack and pinion mechanism for rotating a flapper in the sheet punching apparatus according to the third embodiment of the present invention.

As shown in FIG. 10, an approximately half of the short rack 207 is supported in the length direction by the slide holder 201, and the remaining portion protrudes from the slide holder 201. Gears that mesh with the gear 278*a* are formed on a lower edge of the protruding portion. The gear 278*a* is positioned below the slide holder 201. When the slide holder 201 is at the reference position, the short rack 207 and the gear 278*a* do not mesh. When the slide holder 201 moves from the reference position in the arrow direction A (the two hole position), the short rack 207 and the gear 278*a* mesh to rotate the gear 278*a* in the arrow direction a. When the slide holder 201 returns to the preference position, the gear 278*a* rotates in the arrow direction b. When the slide holder 201 moves from the reference position in the arrow direction B, the gear 278*a* does not rotate, so that the driving force is not transmitted.

Figure 11C:
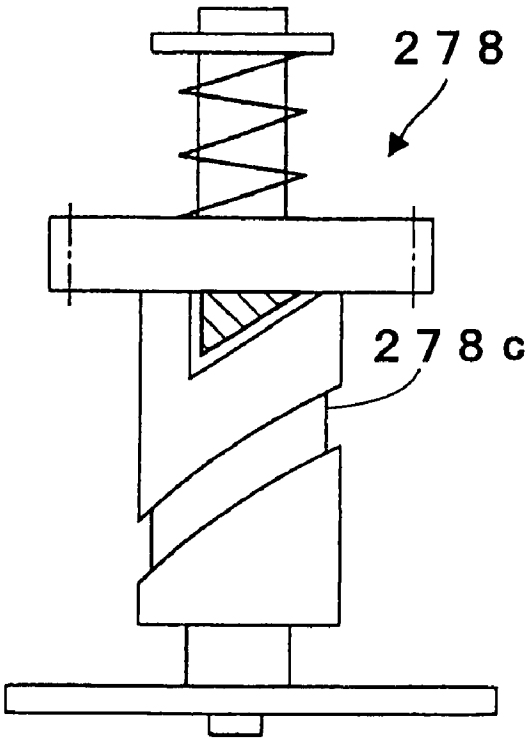
FIGS. 11(*a*) to 11(*c*) are schematic views showing a one-way clutch in the sheet punching apparatus according to the third embodiment of the present invention.
Figure 11B:
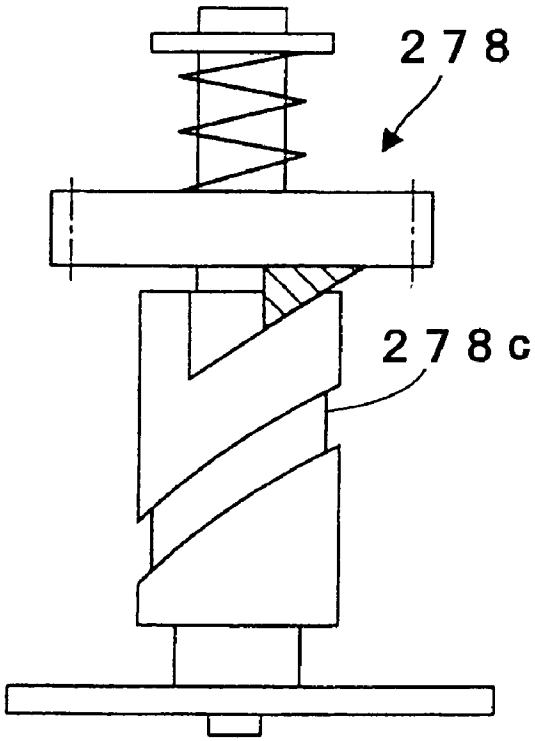
Figure 11A:
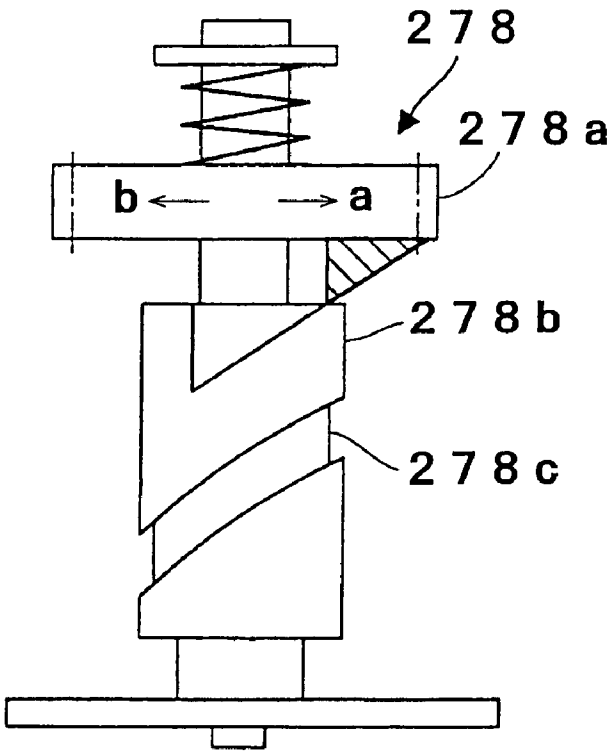

As shown in FIGS. 11(*a*) to 11(*c*), when the gear 278*a* rotates in the arrow direction a, the protrusion on the gear 278*a* and the notched portion on the shaft 278*b* become disengaged, so that the shaft 278*b* does not rotate and the driving force is not transmitted. When the gear 278*a* rotates in the arrow direction b, it passes through the position shown in FIG. 11(*b*) to the position shown in FIG. 11(*c*) where the protrusion on the gear 278*a* and the notched portion on the shaft 278*b* engage.

The shaft 278*b* rotates and transmits the drive force as the gear 278*a* rotates further in the arrow direction b. Therefore, when punching two holes, the flipper is not activated because the drive force is not transmitted. When the slide holder 201 returns to the reference position after punching two holes, the driving force is transmitted by the rotation of the shaft 287*b* to the rotating piece 275 via the slider 277, so that the flapper 261 is activated to level the punch scraps. When the slide holder 201 moves (three hole punch) further in the direction B from the referenced position, the gear 278*a* and rack 207 become unmeshed and the driving force is no longer transmitted to the rotating peace 275. Therefore, the flapper 261 becomes free and moves to the reference position under its own weight.

As the scrap box 270 approaches a full state, the punch scraps are sandwiched between the inner wall of the scrap box 270 and the flapper 261, so that the movement of the flapper 261 is hindered, thereby generating resistance to the movement (see FIG. 5(*c*)). Also, because the spring members are not arranged on the slider 277, resistance to the movement that is generated by the punch scraps is not alleviated (see 266*a* and 266*b* in FIG. 2). Therefore, the load is applied to the drive source motor 280 by the resistance to the movement. When the load is detected, it can be judged that the scrap box 270 is full.

Specifically, the torque meter connected to the motor 280 detects a torque value applied to the motor 280 and outputs the torque value to the torque meter control unit. The torque meter control unit judges that the scrap box 270 is full when the torque value detected by the torque meter exceeds 150% of a predetermined torque value for normal operations of the flapper 261, and it outputs a detection signal (for example, a high level) to the CPU2.

In the sheet punching apparatus 2 of the embodiments of the invention, the driving force is not transmitted to the flapper 261 when punching holes. Furthermore, the driving force is transmitted to the flapper 261 only when the punches 250 are retracted to the retracted positions (when the motor 280 is rotating in reverse after a forward rotation). For this reason, the operational timings are different for punching the holes in the sheets and for leveling the top portion of the punch scraps, so that the load applied to the motor 280 is reduced. Also, because the drive source and the transmission mechanism for the sheet transport are shared, as in the prior art, the sheet transport can be continued even when leveling the punch scraps, so that any decrease in the processing efficiency of the copier 1 can be avoided.

In the sheet punching apparatus 2 of the present embodiment, the torque value applied to the motor 280 is detected to detect that the scrap box 270 is full. When there is still a room in the scrap box 270 for the punch scraps, the flapper moves between positions that touch the opposing inner walls of the scrap box 270, so that the torque value applied to the motor 280 remains a predetermined torque value for the normal operations. On the other hand, as the scrap box 270 approaches the full state, the punch scraps hinder the movement of the flapper 261, so that the torque value applied to the motor 280 increases.

For this reason, when the flapper 261 can not move, the torque meter detects the torque value generated in the motor 280 to detect that the scrap box has reached the full state. Therefore, it is possible to accurately detect that the scrap box is in a full state even when the top portion of the punch scraps are unevenly stacked.

Note that in the embodiment of the present invention, the example is provided for the sheet punching apparatus 2 to be used as a peripheral device on the copier 1A. However, it is perfectly acceptable within the scope of the invention for the sheet punching apparatus 2 to be a stand-alone type, or a unified type that is unified with the copier and disposed inside of the copier, or as a type that is incorporated into a sheet finishing apparatus.

For example, in the stand-alone type, the transfer-in space described above corresponds to the transport unit of the invention, but the transport unit does not necessarily include the sheet transport path 245 in the embodiment of the present invention. Also, in the stand-alone type, the motor 280 and the gears 281 to 286 can be excluded to enable the manual punching process. In the stand-alone type, it is perfectly acceptable to have a separate member for a reference of the punching hole positions for the sheets instead of the position control for the transport positions of the sheets (the positions for punching holes) as described in the embodiment.

Furthermore, in the type incorporated into the sheet finishing apparatus, it is perfectly acceptable to arrange the sheet detection sensor 4 and the pair of transport rollers 5 at a further downstream side, and arrange the sheet punching apparatus at the transport guide 40. Still further, because the sheet finishing apparatus 3 of the embodiment comprises the aligning unit 20, it is perfectly acceptable to arrange the sheet punching apparatus at a downstream side of the aligning unit 20, or at a downstream side of the stapler unit 30. It is possible to perform the batch hole punching process on a sheet stack, thereby making the sheet finishing process faster. In this case, while it is necessary to increase the stroke to advance the punches 250 to penetrate a thickness of the sheet stack, the slider 201 slidably supports the sliders 210 and 211 in a direction perpendicular to the advancing direction of the punches 250 in the sheet punching apparatus 2. Accordingly, the sheet punching apparatus or the sheet finishing apparatus can be made compact while ensuring the strokes for the movement of the punches 250.

Furthermore, in the sheet punching apparatus 2 of the first embodiment, the operational timings for the sheet punching process and the punch scrap or leveling process are overlapped using the rack 205 and pinion 267, and the timings differ because of the one-way clutch 278. However, the present invention is not restricted to the mechanisms. For example, instead of the pinion 267 and shaft 278, a solenoid clutch can be used. It is perfectly acceptable to use the control unit 290 to intermittently connect the solenoid clutch to control the timing of overlap or synchronize the punching process and the leveling process, or to enable different timings.

Still further, the sheet punching apparatus 2 of the present embodiment punches two or three holes. However, the invention is not limited to the embodiment, and the invention can also be applied to providing various holes shapes or various numbers of holes for file binders.

Additionally, the first embodiment uses the detection sensor 292 that detects the detection piece 263. However, the method of detection is not necessarily limited to the embodiment. For example, it is perfectly acceptable to detect the position of the detection piece 263 using an optical method or a magnetic method.

Still further, in the third embodiment, the full status of the scrap box is detected by the torque meter detecting the load applied to the motor 280. However, the invention is not limited to the embodiment, and it is perfectly acceptable to detect the current value or voltage value when driving the motor 280 to achieve the same detection.

An example was provided to judge the full status of the scrap box when the torque value increases. However, it is also perfectly acceptable to output the torque value and judge the full state of the scrap box when a high torque value is detected to continue for a predetermined amount of time (for example, one second). Furthermore, it is also perfectly acceptable to judge the full status of the scrap box through a change in the torque values. In this case, it is possible that the torque meter control unit calculates a difference in the torque values for a predetermined amount of time (for example, one second) and to make the judgment when the difference of the torque values is greater than a predetermined amount.

The disclosures of Japanese Patent Applications No. 2003-398961 and No. 2003-399039, both filed on Nov. 28, 2003, are incorporated in the application.

While the invention has been explained with reference to the specific embodiments of the invention, the explanation is illustrative and the invention is limited only by the appended claims.

What is claimed is:

1. A sheet punching apparatus comprising:

a transport unit for receiving a sheet, a hole punching device for punching a hole in the sheet transported to the transport unit, a punch scrap container for storing punch scraps after the hole punching device punches the hole, a sweeping device for sweeping a top portion of the punch scraps stored in the punch scrap container to level the punch scraps, a drive device for driving the sweeping device and the hole punching device commonly, and a control device for controlling operational timing of the hole punching device and the sweeping device, wherein said control device controls the drive device so that the hole punching device and the sweeping device operate at a same time.

2. A sheet punching apparatus according to claim 1, wherein said drive device includes a motor capable of rotating in forward and reverse directions and a clutch for transmitting a drive of the drive device to the sweeping device when the motor rotates in one of the forward and reverse directions.

3. A sheet finishing apparatus comprising: the sheet punching apparatus according to claim 1, a discharge device for discharging the sheet after the hole punching device punches the hole, and a sheet storage device for storing the sheet after the discharge device discharges the sheet.

4. An image forming apparatus comprising: the sheet punching apparatus according to claim 1, an image forming device for forming an image on the sheet, and a transport device for transporting the sheet after the image forming device forms the image.

5. A sheet punching apparatus according to claim 1, further comprising a detection device for detecting one of a position of the sweeping device and a load applied onto the drive device to determine that the punch scrap container is full.

6. A sheet punching apparatus according to claim 5, wherein said drive device further drives the punching device.

7. A sheet punching apparatus according to claim 5, wherein said sweeping device includes a rotating shaft arranged above the punch scrap container and a sweeping member supported on the rotating shaft for sweeping the punch scraps.

8. A sheet punching apparatus according to claim 5, wherein said sweeping device includes a slide member arranged above the punch scrap container and a sweeping member supported on the slide member for sweeping the punch scraps.

9. A sheet finishing apparatus comprising the sheet punching apparatus according to claim 5, a discharge device for discharging the sheet after the hole punching device punches the hole, and a sheet storage device for storing the sheet after the discharge device discharges the sheet.

10. An image forming apparatus comprising the sheet punching apparatus according to claim 5, an image forming device for forming an image on the sheet, and a transport device for transporting the sheet after the image forming device forms the image.

* * * * *